US008302251B2

(12) United States Patent
Beskow et al.

(10) Patent No.: US 8,302,251 B2
(45) Date of Patent: Nov. 6, 2012

(54) HANDHELD VACUUM UNIT RETENTION FEATURES

(75) Inventors: Jonas Beskow, Stockholm (SE); Håkan Miefalk, Järfälla (SE); Ulrik Danestad, Huddinge (SE)

(73) Assignee: AB Electrolux, Stockholm (SE)

( * ) Notice: Subject to any disclaimer, the term of this patent is extended or adjusted under 35 U.S.C. 154(b) by 46 days.

(21) Appl. No.: 12/797,870

(22) Filed: Jun. 10, 2010

(65) Prior Publication Data

US 2010/0242209 A1 Sep. 30, 2010

Related U.S. Application Data

(63) Continuation of application No. 11/733,683, filed on Apr. 10, 2007, now abandoned.

(60) Provisional application No. 60/886,857, filed on Jan. 26, 2007.

(30) Foreign Application Priority Data

Apr. 10, 2006 (SE) ..... 0600820-5
Apr. 10, 2006 (SE) ..... 0600821-3
Jan. 19, 2007 (SE) ..... 0700143-1

(51) Int. Cl.
*A47L 9/00* (2006.01)
*A47L 9/10* (2006.01)
*A47L 9/20* (2006.01)
*A47L 5/00* (2006.01)

(52) U.S. Cl. ..... 15/329; 15/328; 15/350; 15/336; 15/338

(58) Field of Classification Search ..... 15/350, 15/328, 329, 336, 338
See application file for complete search history.

(56) References Cited

U.S. PATENT DOCUMENTS 3,653,189 A 4/1972 Miyake et al.
4,421,964 A * 12/1983 Buchtel ..... 200/332.2
4,467,493 A * 8/1984 Buchtel ..... 15/323
4,545,089 A * 10/1985 Oxel ..... 15/323
D304,104 S * 10/1989 Busalt et al. ..... D32/18
(Continued)

FOREIGN PATENT DOCUMENTS

CN 1272873 1/2003
(Continued)

OTHER PUBLICATIONS

Fakir product pages catalogue, 2002 (5 pages).

*Primary Examiner* — Bryan R Muller
(74) *Attorney, Agent, or Firm* — Hunton & Williams LLP

(57) ABSTRACT

A vacuum cleaner having a base with an inlet facing a surface, a handle connected to the base, an air passage connecting the base inlet to the handle, and a removable handheld unit. The handheld has an inlet nozzle, a dirt separator, a vacuum fan to generate a working airflow into the inlet nozzle and through the dirt separator, and a housing joining the handheld, the dirt separator and the vacuum fan. The vacuum has a docking latch with a first latch position in which the latch holds the handheld in an operating position on the handle, and a second position in which the latch permits removal of the handheld from the operating position. The vacuum also has a safety catch with a catch member on the handle and a second member on the handheld. The catch members resiliently hold the handheld unit on the handle in a partially-removed position.

12 Claims, 27 Drawing Sheets

U.S. PATENT DOCUMENTS

| | | | | |
|---|---|---|---|---|
| 4,993,106 | A | 2/1991 | Hult et al. | |
| 5,819,364 | A * | 10/1998 | Sham | 15/320 |
| 6,108,864 | A * | 8/2000 | Thomas et al. | 15/350 |
| 6,131,239 | A | 10/2000 | White | |
| 6,324,714 | B1 | 12/2001 | Walz et al. | |
| 6,562,093 | B2 | 5/2003 | Oh | |
| 6,839,934 | B2 * | 1/2005 | Houghton et al. | 15/329 |
| 6,928,690 | B2 | 8/2005 | Ji | |
| 7,377,007 | B2 | 5/2008 | Best | |
| 7,383,609 | B2 | 6/2008 | Ji | |
| 7,507,269 | B2 | 3/2009 | Murphy et al. | |
| 2002/0042969 | A1 | 4/2002 | Nagai et al. | |
| 2002/0073504 | A1 | 6/2002 | Hall et al. | |
| 2003/0019073 | A1 | 1/2003 | Oh | |
| 2004/0040270 | A1 | 3/2004 | Inoue et al. | |
| 2004/0103496 | A1 | 6/2004 | Worwag | |
| 2006/0064828 | A1 | 3/2006 | Stein et al. | |
| 2006/0090290 | A1 | 5/2006 | Lau | |
| 2007/0163075 | A1 | 7/2007 | Butler et al. | |
| 2007/0271724 | A1 | 11/2007 | Hakan et al. | |

FOREIGN PATENT DOCUMENTS

| | | |
|---|---|---|
| DE | 8623004 | 10/1986 |
| DE | 4038262 | 6/1992 |
| DE | 10110581 | 11/2001 |
| DE | 10124216 | 1/2002 |
| EP | 1 070 478 | 1/2001 |
| EP | 1224898 | 7/2002 |
| EP | 1 279 362 | 1/2003 |
| GB | 2155314 | 9/1985 |
| GB | 2 349 105 | 10/2000 |
| GB | 2 372 434 | 8/2002 |
| JP | 2000-070198 | 3/2000 |
| JP | 2001-095735 | 4/2001 |
| JP | 2001353110 | 12/2001 |
| WO | WO 97/20492 | 6/1997 |
| WO | WO 03/009736 | 2/2003 |
| WO | WO 2004/069021 | 8/2004 |
| WO | WO 2005/111084 | 11/2005 |

* cited by examiner

HANDHELD VACUUM UNIT RETENTION FEATURES

CLAIM OF PRIORITY

This application claims priority as a continuation of U.S. application Ser. No. 11/733,683, filed on Apr. 10, 2007 now abandoned, which claims priority to Swedish Application No. 0600821-3 filed on Apr. 10, 2006; Swedish Application No. 0600820-5, filed on Apr. 10, 2006, Swedish Application No. 0700143-1, filed on Jan. 19, 2007, and U.S. Provisional Application No. 60/886,857, filed on Jan. 26, 2007. The foregoing priority references are incorporated herein by reference in their entirety.

FIELD OF THE INVENTION

The present invention relates generally to convertible stick vacuum cleaners having a removable handheld vacuum component, free standing handheld vacuum cleaners, upright vacuum cleaners and various improvements to such devices and other types of vacuum cleaners.

BACKGROUND OF THE INVENTION

Electric vacuum cleaners are in widespread use in homes, offices and other places where quick and efficient floor cleaning is desired. Such vacuum cleaners are provided in various configurations, such as upright, canister, "stick," and "powerhead" designs. Some vacuum cleaners have been provided in convertible form, in which they are capable of being converted from one form of vacuum cleaner to another. For example, some upright vacuum cleaners are convertible to operate in canister form, and vice-versa. It is also known to provide stick vacuum cleaners that have removable handheld components. Such a device is shown in U.S. patent application Ser. No. 10/544,927, which is incorporated herein by reference. Other similar devices include the vacuum cleaner shown in U.S. Pat. No. 6,839,934 (which also has a removable upper handle element), U.S. Pat. No. 6,964,082, and D307, 657, which are all incorporated herein by reference.

The suction efficiency of these and other vacuum cleaners is determined both by, among other things, the efficiency of the vacuum source and the suction losses that occur in the air passages through the vacuum cleaner. Avoiding air flow losses in the air passages is important in all kinds of vacuum cleaners in order to achieve a high suction efficiency and reduce energy consumption. However, it is especially important in vacuum cleaners having an electric motor powered by batteries. In such a case it is not a preferred option to compensate for air flow losses in the air passages by increasing the motor power, because this will shorten battery life and necessitate more frequent recharging. Alternatively, the battery power capacity could be increased by providing more batteries in the vacuum cleaner, but this can increase the cost and weight of the vacuum cleaner. It has been found that reducing airflow losses is also particularly important in stick vacuum cleaners and so-called 2-in-1 vacuum cleaners (stick vacuums with removable handheld vacuums), which often have a relatively long airflow path.

While the foregoing devices, and others similar to those, have been successfully used in the marketplace, there still exists a need to provide alternative designs having improved ergonomics, performance, ease of use, ease of manufacture, or other benefits and/or features.

SUMMARY OF THE INVENTION

The following summary is not intended to limit the invention set forth in the claims in any manner.

In a one aspect, an exemplary embodiment of the present invention provides a vacuum cleaner having a base with a base inlet positioned to face a surface to be cleaned, a handle pivotally connected to the base, an air passage connecting the base inlet to the handle, and a removable handheld unit that is selectively connectable to the handle. The removable handheld unit has a handheld inlet nozzle, a dirt separator, a vacuum fan adapted to selectively generate a working airflow into the handheld inlet nozzle and through the dirt separator, and a housing joining the handheld inlet nozzle, the dirt separator and the vacuum fan. The vacuum cleaner has a docking latch having a first latch position in which the docking latch holds the handheld unit in an operating position on the handle, and a second latch position in which the docking latch permits removal of the handheld unit from the operating position. The handheld inlet nozzle is in fluid communication with the air passage when the handheld unit is in the operating position. The vacuum cleaner also has a safety catch having a first catch member on the handle and a second catch member on the handheld. The first catch member and the second catch member are configured to resiliently hold the handheld unit on the handle in a partially-removed position.

In another aspect, an exemplary embodiment of the present invention provides a vacuum cleaner having a base with a base inlet positioned to face a surface to be cleaned, a handle pivotally connected to the base, an air passage connecting the base inlet to the handle, and a removable handheld unit that is selectively connectable to the handle. The removable handheld unit has a handheld inlet nozzle, a dirt separator, a vacuum fan adapted to selectively generate a working airflow into the handheld inlet nozzle and through the dirt separator, and a housing joining the handheld inlet nozzle, the dirt separator and the vacuum fan. The vacuum cleaner has a docking means for selectively holding the handheld unit in an operating position on the handle. The handheld inlet nozzle is in fluid communication with the air passage when the handheld unit is in the operating position. The vacuum cleaner also has a safety catch means for holding the handheld unit on the handle in a partially-removed position.

In another aspect, an exemplary embodiment of the present invention provides a vacuum cleaner having a base with a base inlet positioned to face a surface to be cleaned, a handle pivotally connected to the base, an air passage connecting the base inlet to the handle, and a removable handheld unit that is selectively connectable to the handle. The removable handheld unit has a handheld inlet nozzle, a dirt separator, a vacuum fan adapted to selectively generate a working airflow into the handheld inlet nozzle and through the dirt separator, and a housing joining the handheld inlet nozzle, the dirt separator and the vacuum fan. The vacuum cleaner has a docking latch having a hook on one of the handle and handheld unit, and a latch on the other of the handle and the handheld unit. At least one of the hook and the latch is movable into engagement with the other to hold the handheld unit in a first position on the handle. The vacuum cleaner also has a safety catch having a first catch member on the handle and a second catch member on the handheld. The first catch member and the second catch member are configured to resiliently hold the handheld unit on the handle in a partially-removed position.

Other embodiments, features and variations are also included within the scope of the invention, as will be apparent from studying the appended claims.

BRIEF DESCRIPTION OF THE DRAWINGS

Various embodiments of inventions are illustrated in the appended drawings, in which like reference numbers are used to describe like parts. The embodiments shown in the drawings are exemplary embodiments of the invention, and not intended to limit the scope of the appended claims.

DETAILED DESCRIPTION OF THE PREFERRED EMBODIMENTS

The present disclosure generally provides a novel convertible stick vacuum cleaner having various unique features. The devices and features described herein provide a number of different inventions that may be used together, separately, or in combination. While the features described herein and illustrated in the accompanying figures are shown in the context of a convertible (i.e., 2-in-1) stick vacuum cleaner, it will be understood that aspects of the invention can also be practiced with a wet or dry extractor, an upright or canister vacuum cleaner, other stick vacuums and electric brooms, a central vacuum cleaner, or with other types of vacuum cleaners or other cleaning devices. As used herein, the expressions "vacuum cleaner" and "vacuum" are intended to include any cleaning device that uses a suction source to remove dirt or other undesirable substances from surfaces, regardless of whether it includes specialty features, such as a fluid deposition system and fluid recovery tank (as in wet extractors), and regardless of what type of dirt separation system it uses (such as cyclonic, bag, or dirt cup separation systems). These and other variations will be apparent to those of ordinary skill in the art in view of the present disclosure.

Figure 1B:
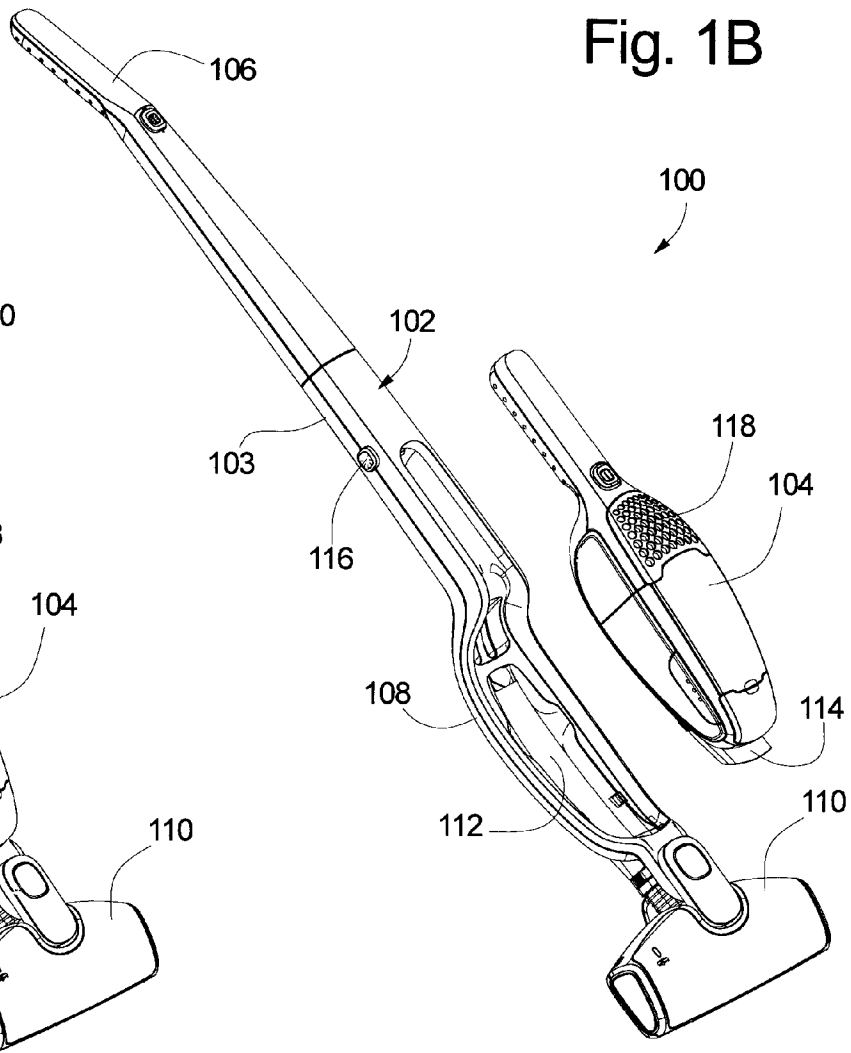
FIG. 1B is an isometric view of the convertible stick vacuum of FIG. 1A, shown with the handheld removed from the stick assembly.
Figure 1A:
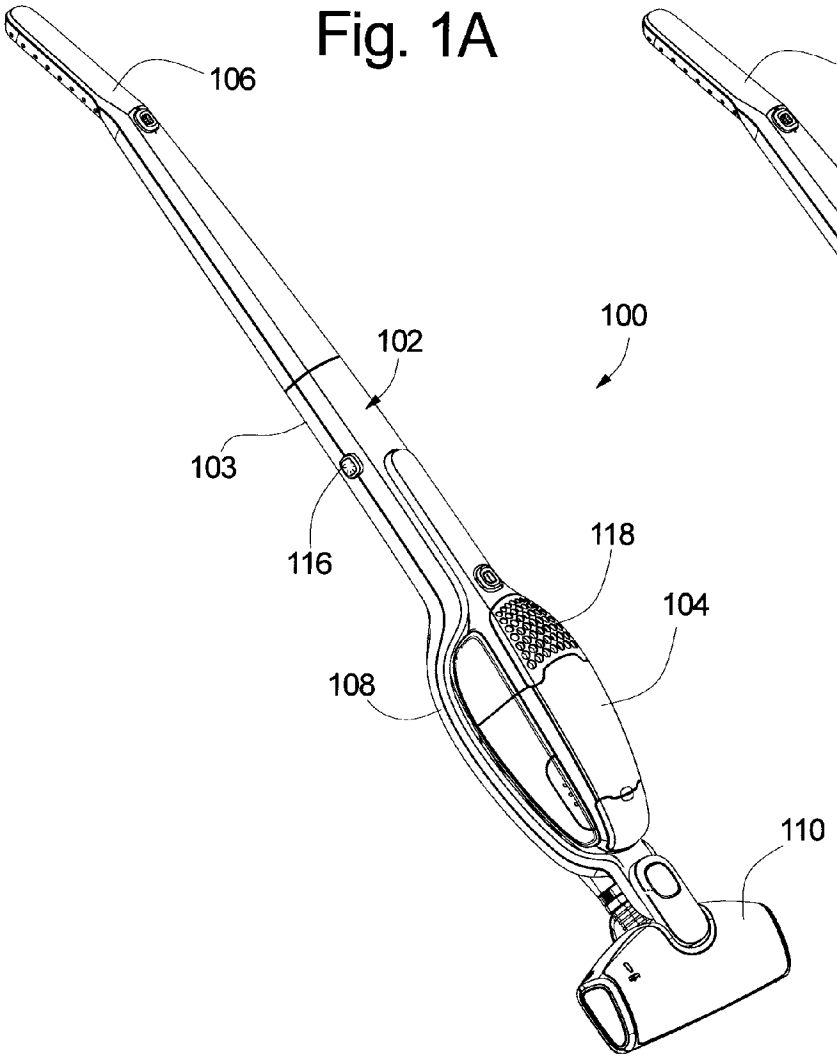
FIG. 1A is an isometric view of a convertible stick vacuum of the present invention, shown with the handheld vacuum attached to the stick assembly.
Figure 1C:
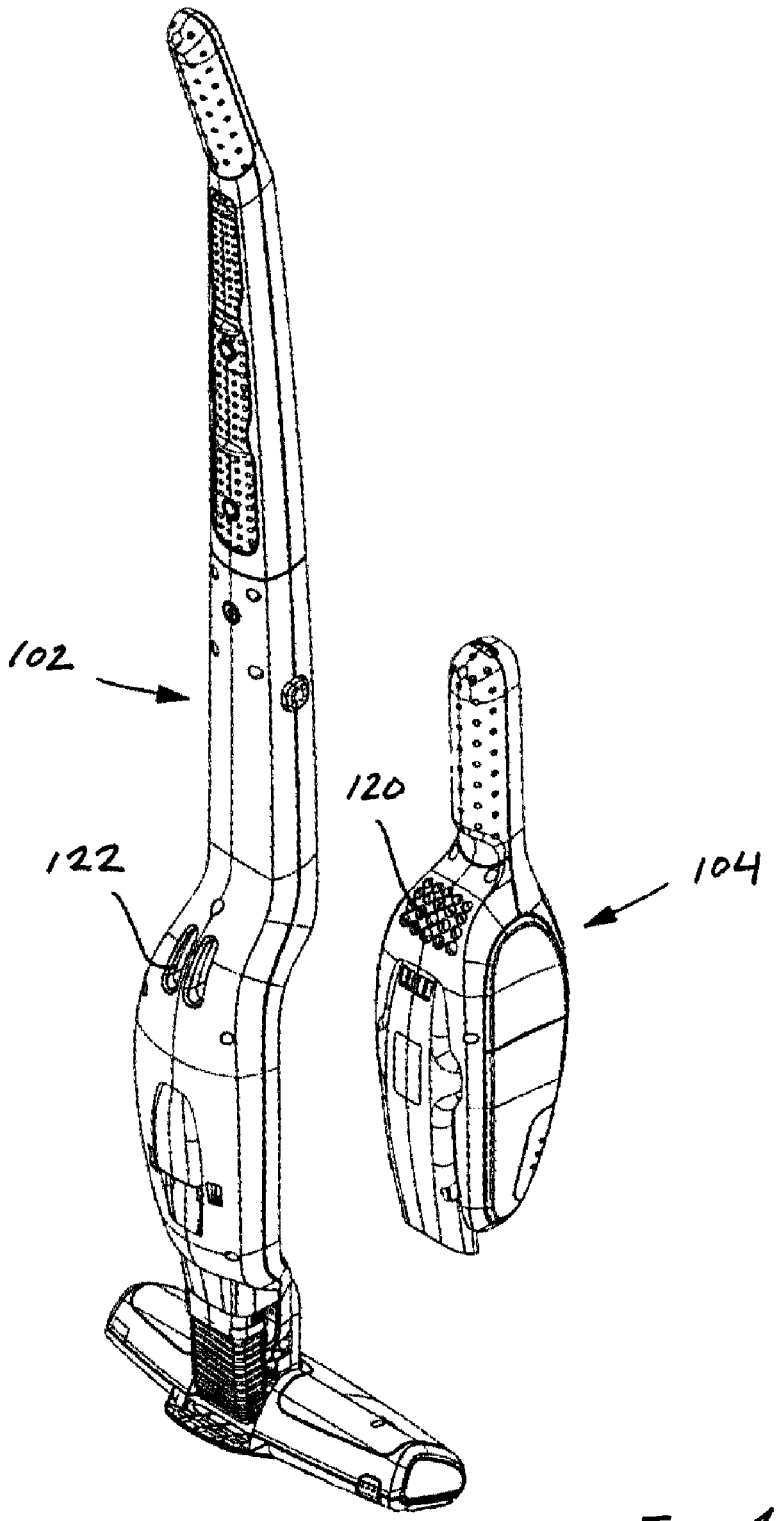
FIG. 1C is an isometric rear view of the convertible stick vacuum of FIG. 1A, shown with the handheld removed from the stick assembly.

Referring now to FIGS. 1A through 1C, a preferred convertible stick vacuum 100 of the present invention includes a stick assembly 102 and a handheld vacuum (or simply "handheld") 104 that can be mounted and dismounted from the stick assembly 102. The stick assembly 102 comprises a handle 103, which has a grip portion 106 located at one end thereof and a mounting portion 108 located along the length of the handle 103. The stick assembly 102 also preferably includes a base 110, which is attached to the end of the handle 103 opposite the grip portion 106. The grip portion 106 is positioned and shaped to be grasped by a user to manipulate the device when the handheld 104 is attached to the stick assembly 102 to thereby operate the device in the stick vacuum mode, as shown in FIG. 1A. The mounting portion 108 is provided with a mounting recess 112 (FIG. 1B) or other mounting structure to which the handheld 104 is attached. The base 110 is attached to the handle 103 either by a rigid attachment or by one or more pivots, and may be removable for use without it.

The handheld 104 comprises a vacuum motor that draws dirt-laden air into a handheld inlet nozzle 114. When the handheld 104 is connected to the handle 103, the inlet nozzle 114 is connected with a inlet in the base 110. The handheld exhausts the airflow through one or more exhaust outlets 118, 120. One way to further restrict the air flow losses through the vacuum cleaner is to reduce the air flow resistance through these outlets. To this end, larger and/or multiple outlets may be used. To accommodate the desired size, number or location of these outlets, it may be necessary or desirable to locate some of the outlets 120 on the portion of the handheld 104 that faces the handle 103, in which case airflow openings 122 may be formed through the handle 103 to allow airflow from such an outlet 120 to pass relatively freely to the environment. Of course, where the stick vacuum is not provided with a separate handheld portions, such airflow openings on the rear side of the stick may still be desirable.

Figure 2A:
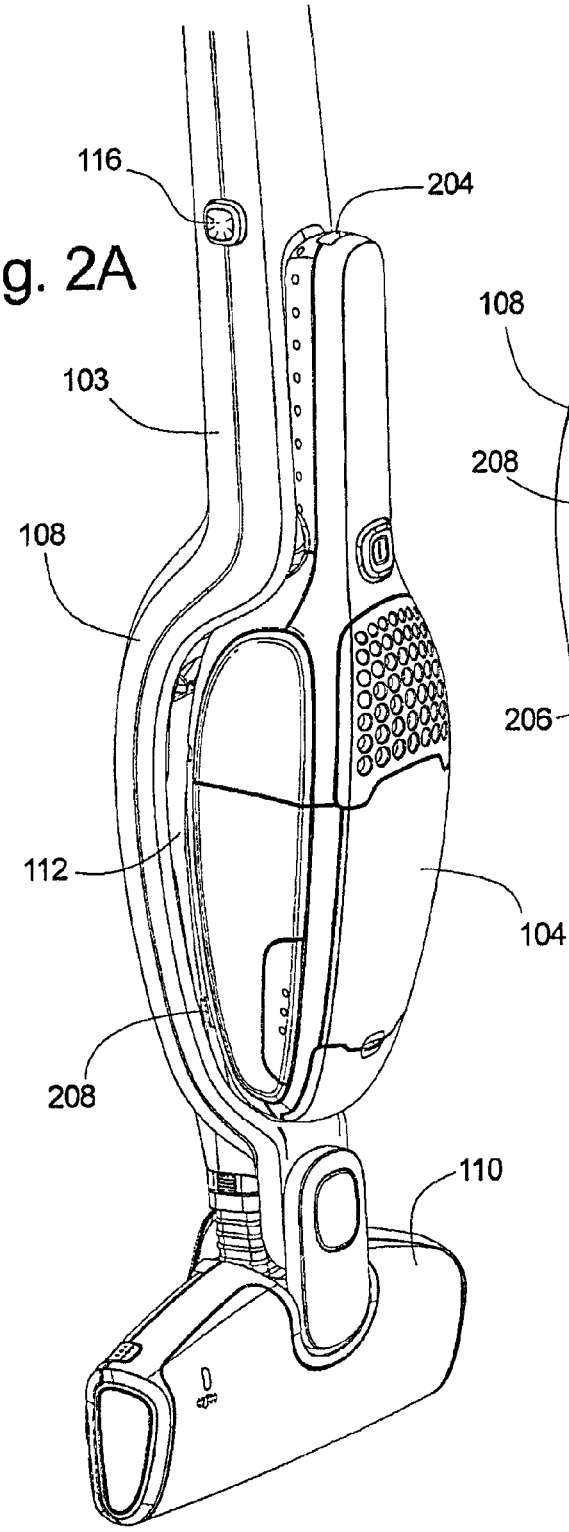
FIG. 2A is a fragmented isometric view of the convertible stick vacuum of FIG. 1A, shown with the handheld vacuum resting in a partially-removed position.
Figure 2B:
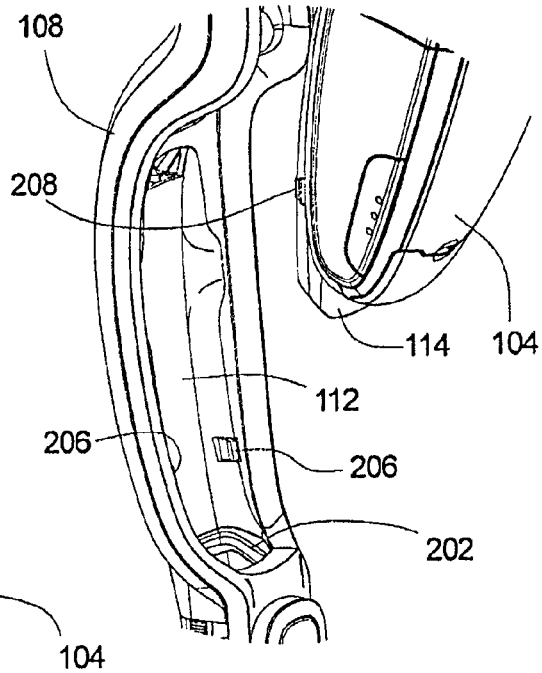
FIG. 2B is a fragmented isometric view of the convertible stick vacuum of FIG. 1A, shown with the handheld vacuum removed from the stick.

Referring now also to FIGS. 2A and 2B, the handheld 104 may be retained in the stick assembly 102 by any suitable arrangement of latches, catches, hooks, or the like. For example, in the shown embodiment, the mounting recess 112 comprises a cavity that is shaped to generally follow the contours of the bottom of the handheld 104 so that the handheld 104 fits into the stick assembly 102 to provide the assembled device with a smooth and integrated appearance. The handheld 104 is retained in the recess 112 at its lower end by the handheld inlet nozzle 114, which protrudes from the surface of the handheld 104 and hooks into a corresponding inlet conduit opening 202 in the recess 112. The inlet conduit opening 202 is in fluid communication with an inlet located in the base 110, which is described in more detail subsequently herein. The upper end of the handheld 104 is retained in the recess 112 by a moveable docking latch 352 (see FIGS. 3, 5A and 5B), which engages a latch receptacle 204 (FIG. 2A) at or near the end of the handheld 104. In this configuration, the handheld 104 is attached to the stick assembly 102 by sliding the inlet nozzle 114 into the inlet conduit opening 202 and tilting the handheld 104 backwards into the recess 112 until the docking latch 352 engages the latch receptacle 204. To remove the handheld 104, the docking latch 352 is actuated, such as by depressing one or more docking latch buttons 116 on the stick assembly 102, to disengage the docking latch 352 from the latch receptacle 204, at which point the handheld 104 can be grasped and withdrawn from the mounting receptacle 112. While the foregoing attachment regime is preferred, any other suitable manner of attaching the handheld 104 to the stick assembly 102 may be used.

Referring specifically to FIGS. 2A and 2B, the present invention is preferably constructed with a safety catch that holds the handheld 104 in the stick assembly 102 in a partially-removed state, as shown in FIG. 2A. The safety catch is helpful to prevent the handheld 104 from falling, should the user disengage the hook or other retaining mechanism without being prepared to take control of the handheld 104. To this end, the mounting recess 112 preferably comprises a pair of clips 206 that fit into corresponding detents 208 on each side of the handheld (only one clip 206 and one detent 208 are fully visible). The clips 206 are resiliently biased towards the detents 208, such as by being mounted on cantilevered or other flexible portions of the housing that forms the mounting recess 112, by being spring biased, or by other known mechanisms. The clips 206 are positioned such that they fit into and/or engage the detents 208 when the handheld 104 has been partially removed from the mounting recess 112. In this position, the clips 206 and detents 208 cooperate by their engagement to help prevent the handheld 104 from falling out of the stick assembly 102. To fully remove the handheld 104, the user pulls on the handheld 104 to overcome the retaining force between the clips 206 and detents 208.

While the foregoing arrangement is preferred, other safety catch arrangements may alternatively be used. For example, the locations of the clips 206 and detents 208 may be reversed, or the detents 208 may be replaced by rigidly- or resiliently-mounted clips. The safety catch may also comprise a latch that the user must specifically actuate to remove the handheld 104. It should also be apparent from the foregoing disclosure that the preferred safety catch may not necessarily prevent the handheld 104 from falling out of the stick assembly 102 under all conditions, but instead is useful for this function only when the device is operated in the normally-expected manner—namely, when the stick handle 103 is generally vertically oriented.

Figure 3:
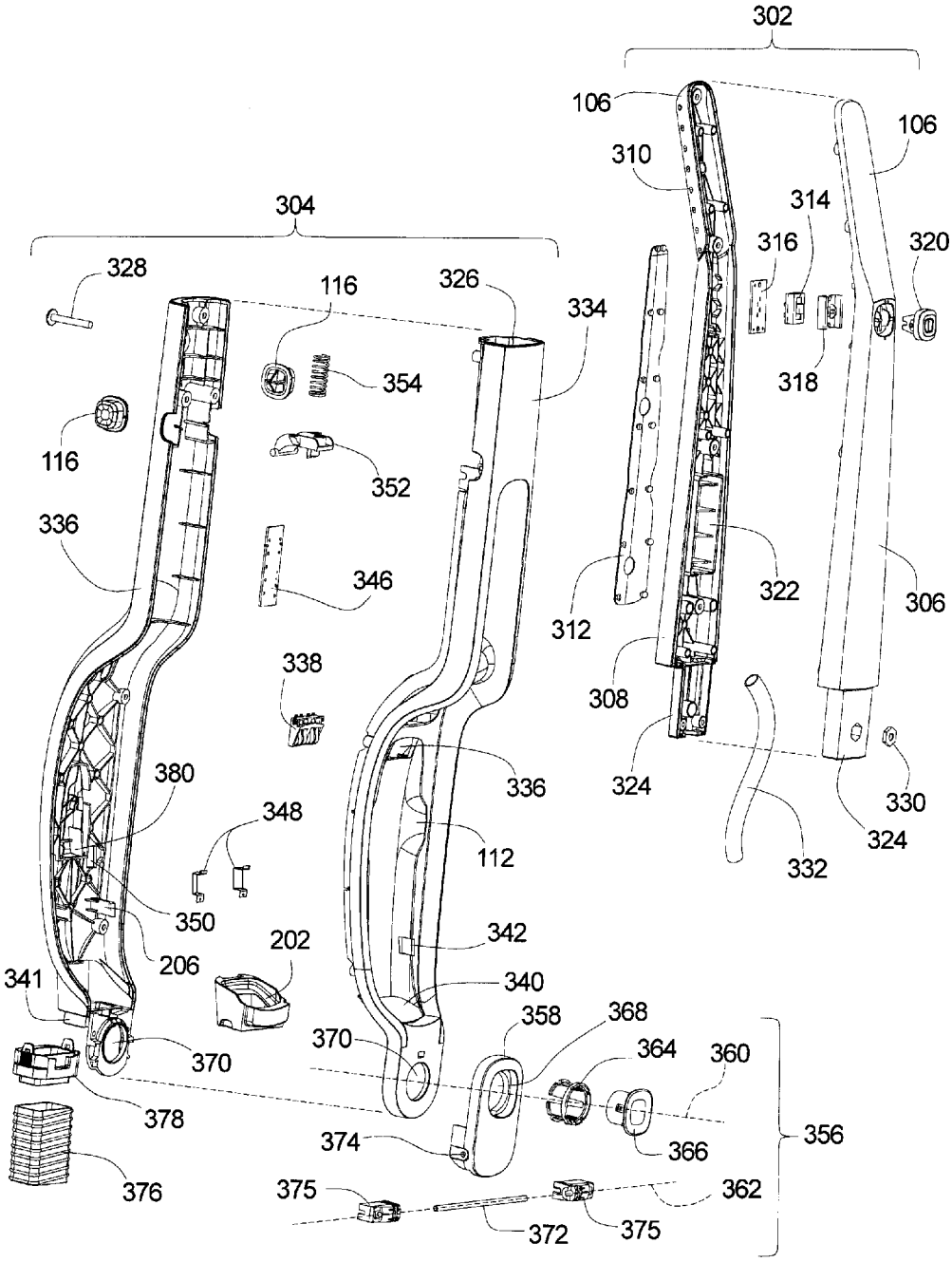
FIG. 3 is an exploded view of the stick handle of FIG. 1A.

Referring now to FIG. 3, an embodiment of a stick handle 103 of the present invention is shown in exploded view. In this embodiment, the stick handle 103 is made of two main parts, an upper handle 302, and a lower handle 304, to allow it to be partially disassembled for more compact storage and shipping. While preferred, this two-part construction is not required, and constructions having a single main part or more than two main parts may be used in other embodiments.

The upper handle 302 is generally formed by front and rear upper handle housing shells 306, 308, which are joined to one another by snap fitment, screws, ultrasonic welds, adhesives, or the like. The upper end of the upper handle 302 is shaped to form the grip portion 106 of the stick assembly 102. If desired, some or all of the grip portion 106 may be formed with grip-enhancing features such as dimples 310. The grip portion 106 may also be painted or overmolded with a rubber or thermoplastic material that provides a comfortable or tactile gripping surface, as known in the art.

Figure 4:
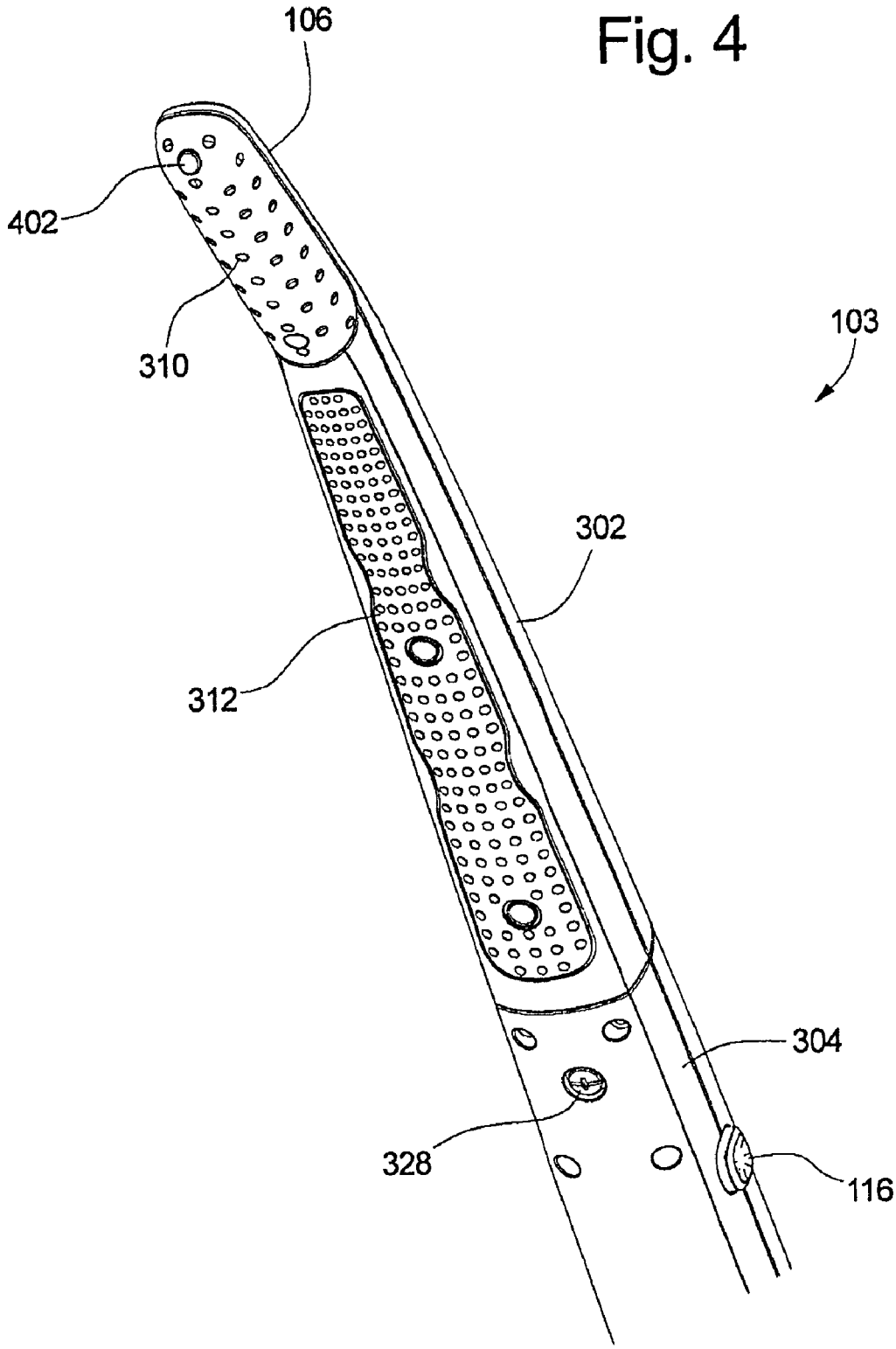
FIG. 4 is a fragmented rear isometric view of the grip portion of the stick handle of FIG. 1A.

The upper handle 302 also may include one or more features to help prevent the vacuum cleaner from slipping on surfaces against which it might be leaned for temporary storage. For example, as shown in FIGS. 3 and 4, a slip-resistant insert 312 may be attached or molded to the back of the rear upper handle housing shell 308 to help prevent the stick assembly 102 from sliding when it is leaned against a table, counter, or other ledge. The slip-resistant insert 312 may comprise any tactile material, or a material having hooks, bumps, dimples, ridges or other surface features that tend to increase surface friction or otherwise resist sliding. The upper handle 302 may also include a slip-resistant bump 402 or protrusion on the end of the grip portion 106 to contact vertical surfaces, such as walls, against which the device may be leaned. Further embodiments and examples of slip-resisting features that may be used with the present invention are shown in FIGS. 4A-4E.

Figure 4A:
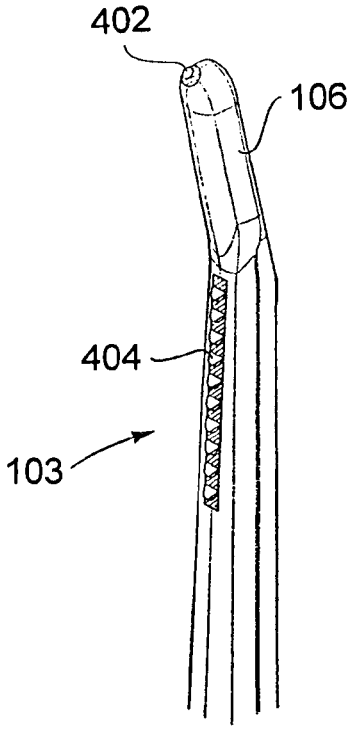
FIG. 4A is a fragmented rear isometric view of an alternate embodiment of the grip portion of the stick handle of FIG. 1A.

An alternative embodiment of stick handle 103 is shown in FIG. 4A. In the illustrated embodiment, the vacuum cleaner is provided with a slip-resistant insert 404 in the area immediately beneath the grip portion 106 and a slip-resistant bump 402 in the upper end of the handle. Both the insert 404 and the bump 402 are manufactured of a high friction material. As is indicated in FIG. 4, the grip portion 106 may include dimples 310 or be smooth as shown in FIG. 4A. Moreover, the slip-resistant insert may be textured as in FIG. 4 (item 312) or the slip-resistant insert may be ridged as in FIG. 4A (item 404).

Figure 4B:
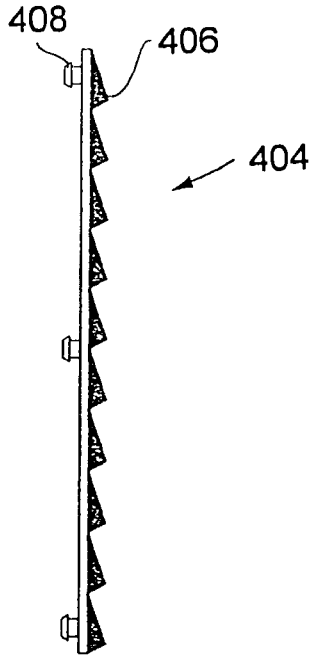
FIG. 4B is a longitudinal section through a slip-resistant insert of FIG. 4A.

FIG. 4B illustrates in greater detail the alternative embodiment of the slip resistant insert 404. Here the insert 404 includes ridges 406 transverse to the insert length. Seen in longitudinal section of the insert, the ridges 406 are formed as shark fins or saw teeth to assist with gripping the edge of a table top or the like. On an inner surface, the insert 404 is provided with a number of projections 408, which are adapted to be pressed into respective holes in the stick handle 103 to fasten the insert 404 thereto.

Figure 4C:
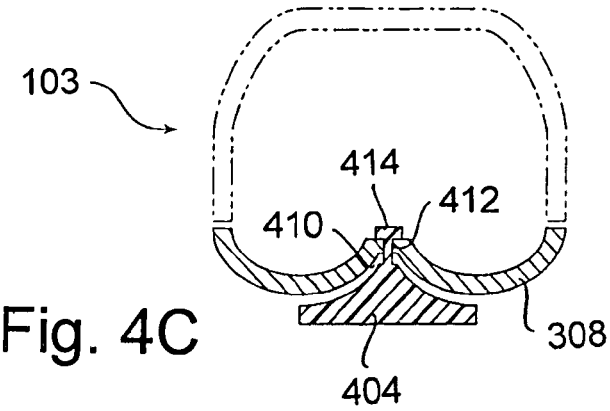
FIG. 4C is a cross sectional cutaway view through an alternative embodiment of a stick handle having a "cast-on" strip of a slip-resistant insert.

FIG. 4C illustrates an additional alternative embodiment for forming and attaching a slip-resistant insert 404 to the stick handle. Here a rear upper handle housing shell 308 is shown in cross section and, as is shown, the housing shell 308 is in the longitudinal direction formed with a centric positioned groove 410. The insert 404 is cast formed over the groove 410 on the housing shell in a liquid or plastic state and subsequently hardened. When the housing shell 308 includes through-holes 412, the liquid or plastic compound may penetrate into the holes and, after subsequent hardening, form attaching members 414, thereby attaching and securing insert 404 to the housing shell 308.

Figure 4D:
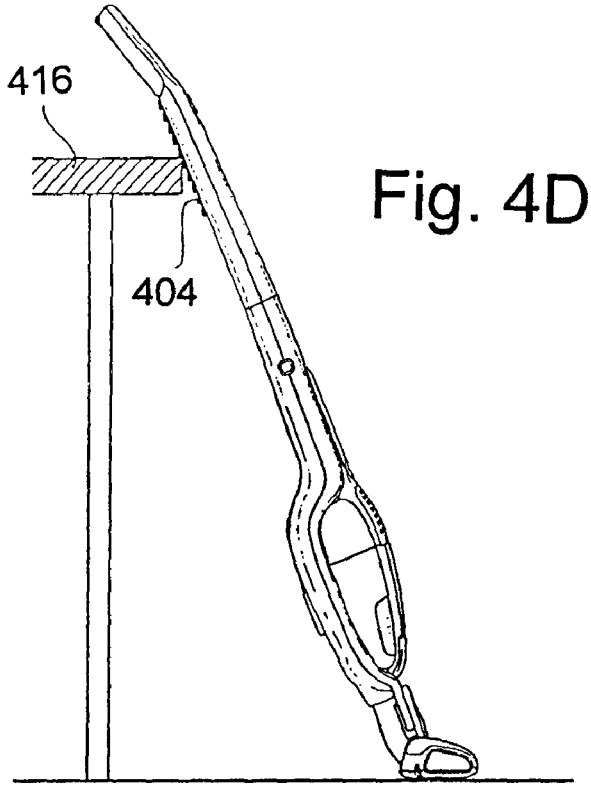
FIG. 4D is a side view of a vacuum cleaner leaned against a table top.
Figure 4E:
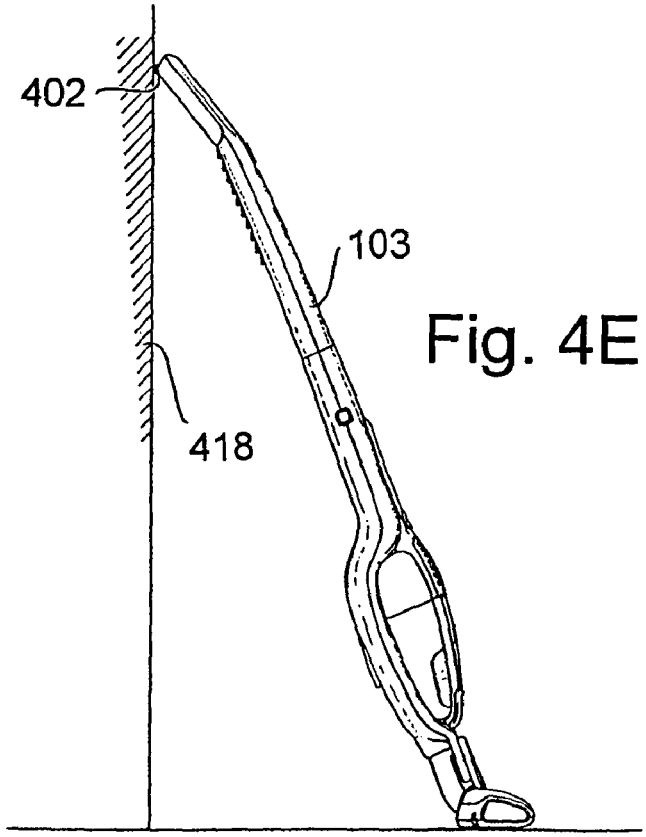
FIG. 4E is a side view of a vacuum cleaner leaned against a wall.

FIGS. 4D and 4E illustrate the benefits of providing a vacuum cleaner with the slip-resistant components according to the invention. Accordingly, the vacuum cleaner can be leaned against the edge of a table top 416, as is shown in FIG. 4D, such that the slip-resistant insert 404 on the rear side of the stick handle bears against the edge, which will prevent the vacuum cleaner from sliding forward and falling to the floor. With a slip-resistant bump 402 on the upper end of the stick handle 103, the vacuum cleaner also can be leaned towards a wall 418, as is shown in FIG. 4E, without the risk of falling sideways to the floor.

The upper handle also may include a switching arrangement for operating the device in the stick vacuum mode. Turning back to FIG. 3, an example switching arrangement includes an electric switch 314, a circuit board 316 (if necessary), a switch slider 318, and a switch actuator 320. The switch actuator 320 is mounted to the front upper housing shell 306 and located to be readily operated by a user's thumb. The switch actuator 320 is attached to the switch slider 318, which converts the switch's rocking motion into a linear sliding motion and moves the switch 314 between its various operating positions. The switch 314 is mounted to the circuit board 316, which is connected to the remainder of the device by suitable electrical wiring (not shown). These and other suitable switch mechanisms are known in the art.

In a preferred embodiment, there are at least two operating positions for the switch actuator 320 and switch 314: a first position in which the vacuum fan and brushroll motor (if one is provided) are off, and a second position in which the vacuum fan and brushroll motor are activated. If desired, additional operating positions may be provided. Examples of such operating positions include a position in which the vacuum fan is activated but the brushroll motor is not (or vice-versa), and a position in which the vacuum fan and/or brushroll motor is operated at a reduced power level.

The upper handle 302 may also include various other useful features. For example, one or more auxiliary batteries (not shown) may be mounted in a cavity 322 between the front and rear upper handle housing shells 306, 308. Such auxiliary batteries would supplement the power provided by batteries in the handheld 104 (see FIG. 9) when the device is operated in the stick vacuum mode. In addition, cleaning tools, such as inlet nozzle attachments, or other electronics, such as charging circuitry, may be stored in the upper handle 302.

When the front and rear upper handle housing shells 306, 308 are attached to one another, they form a mounting post 324 that fits into a corresponding mounting hole 326 in the lower handle 304. When so assembled, a screw 328 and nut 330 are used to secure the upper and lower handles 302, 304 together. Of course, other attachment mechanisms, such as snap fitments or bayonet fittings, may be used instead. In those embodiments that include electrical components (such as batteries or switches 314) in the upper handle 302, a wiring sheath 332 comprising a durable material (such as a cloth or synthetic woven sheath or a rolled plastic sheet or tube) may be provided between the upper handle 302 and lower handle 304 to prevent user exposure to the wires to and protect the electrical wires passing therebetween from being damaged when the upper and lower handles 302, 304 are assembled or disassembled.

Still referring to FIG. 3, the lower handle 304 preferably is formed by front and rear lower handle housing shells 334, 336, respectively. The handheld mounting recess 112 may be formed in either housing shell to position the handheld 104 on the front, back or side of the stick assembly 102. The mounting recess 112 may alternatively be formed partially or entirely in the upper handle 302. In the shown embodiment, the mounting recess 112 is formed in the front surface of the front lower handle housing shell 334. A first opening 336 is provided through the front lower handle housing shell 334 through which an electrical contact terminal 338 extends to electrically connect the handheld 104 to the stick assembly 102. Other electrical components mounted in the lower handle 304 may also include a printed circuit board 346 that includes control logic circuitry for the vacuum cleaner and/or battery charging controls, and a pair of main electrical contacts 348 which extend through holes 350 in the rear lower handle housing 336 to contact corresponding electrical contacts 1408 on the device's charging stand (see FIGS. 14A and 14B). The rear lower handle housing 336 also includes a slot 380 into which a corresponding hook 1406 on the charging stand fits to mount the vacuum 100. If no charging stand is used, the electrical contacts 348 may be replaced by a charger plug receptacle (not shown) or a conventional power cord.

A second opening 340 is provided through the front lower handle housing shell 334 at the bottom of the mounting recess 112 through which the inlet nozzle 114 of the handheld 104 may pass to engage the inlet conduit opening 202. A corresponding opening 341 is provided through the rear lower handle housing shell 336 to provide an airflow path through the lower handle 304. As shown in FIG. 3, the inlet conduit opening 202 is formed as a separate part that is captured between the front and rear lower handle housing shells 334, 336, and fluidly between the two corresponding openings 340, 341, but it may instead be formed in one of the housing shells 334, 336. In a preferred embodiment, the part that forms the inlet conduit opening 202 comprises a relatively soft rubber or thermoplastic material that forms a seal against the handheld inlet nozzle 114 when it is attached thereto, but such a seal may instead by formed by gaskets, o-rings, closely-fitting parts, or other known devices.

The mounting recess 112 also includes a pair of third openings 342 located on opposite sides of the recess 112 (only one such opening 342 is visible in the view of FIG. 3). The safety catch clips 206, the purpose of which was described previously herein, extend as cantilevered protrusions from the rear lower handle housing shell 336. When the front and rear lower handle housing shells 334, 336 are assembled, the clips 206 extend into the third openings 342 to cooperate with the detents 208 on the handheld 104 when the handheld 104 is installed in the mounting recess 112.

Figure 5B:
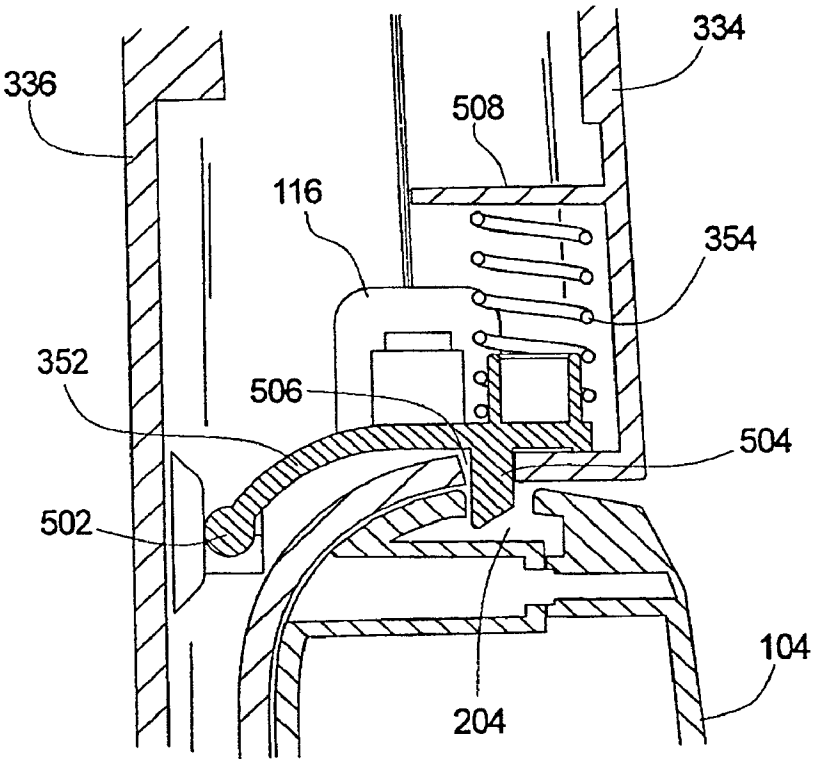
FIGS. 5A and 5B are front and side cutaway views, respectively, of the handheld latch of the embodiment of FIG. 1A.
Figure 5A:
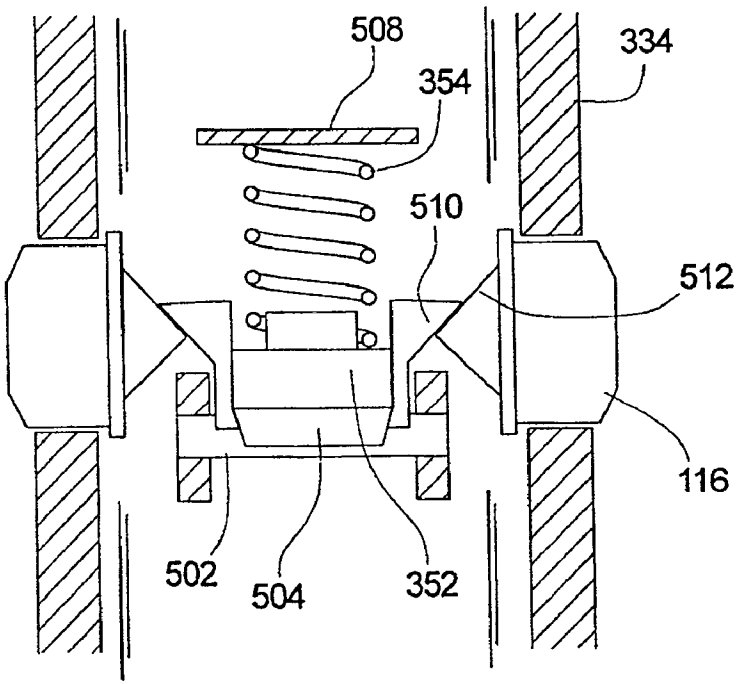

Referring now to FIGS. 3, 5A and 5B, the docking latch 352 and a pair of docking latch buttons 116 are captured between the front and rear lower handle housing shells 334, 336. As best shown in FIG. 5B, the docking latch 352 comprises a pivot 502 at one end, which is pivotally mounted to the rear lower handle housing shell 336, and a hook 504 at the other end. The hook 504 is positioned to pass through a corresponding hole 506 through the front lower handle housing shell 334 to enter the mounting recess 112 and engage the latch receptacle 204 located at the end of the handheld 104. A spring 354 is provided between the docking latch 352 and a spring seat 508 projecting from the inner surface of the front lower handle housing shell 334 to resiliently bias the docking latch 352 into the engaged position.

As best shown in FIG. 5A, the docking latch 352 further includes a pair of latch cam surfaces 510 that project laterally and upwardly from each side of the docking latch 352. The latch cam surfaces 510 are positioned adjacent corresponding button cam surfaces 512 on the docking latch buttons 116. In use, either or both of the buttons 116 may be depressed to engage the button cam surfaces 512 with the latch cam surfaces 510 to lift the docking latch 352 against the bias of the spring 354. With the docking latch 352 lifted, the hook 504 clears the latch receptacle 204, and the handheld 104 may be removed. The above steps can be reversed to replace the handheld 104, or the user may simply press the handheld 104 against the hook 504 to drive the docking latch 352 upwards against the bias of the spring 354. To this end, one or both of the hook 504 and the handheld 104 may have a sloped cam surface to reduce friction between the two parts when replacing the handheld 104.

Turning back to FIG. 3, the stick handle 103 also includes a pivot assembly 356 for mounting the stick handle 103 to the base 110 (FIG. 1). The pivot assembly 356 comprises a pivot link 358 which is mounted to the lower handle 304 such that it can pivot about a first axis 360, and to the base 110 such that it can pivot about a second axis 362. In a preferred embodiment, the first axis 360 is oriented generally in a plane parallel to the fore-aft direction of the device (i.e., the direction of normal travel of the device) and perpendicular to the long axis of the stick handle 103. The second axis is generally parallel to the surface upon which the base 110 rests, and perpendicular to the fore-aft direction. The first and second axes 360, 362 preferably are perpendicular to one another. While it is preferred to use this or similar two-axis articulating joints to join the handle 103 to the base 110, other types of articulating joints, such as those that provide a single pivot axis between the base 110 and the handle 103, may instead be used. Such articulating joints are commonly used in upright, stick and canister vacuum cleaners, and non-limiting examples of such devices are shown in U.S. Pat. Nos. 4,376,322; 5,107,567; 5,367,741; and 5,819,366, which are incorporated herein by reference.

A clip joint 364 and clip joint lock 366 are used to mount the pivot link 358 to the lower handle 304. The clip joint 364 comprises a cylindrical device that fits within a first hole 368 through the pivot link 358, and a second hole 370 through the lower handle 304 (the second hole 370 preferably is formed through both the front and rear lower housing shells 334, 336). The clip joint 364 is flared at each end to capture the pivot link 358 and lower handle 304 together, and provided with slotted sidewalls to allow one of the flared ends to be flexed inwardly to allow the clip joint 364 to pass through the holes 368, 370. Once in place, the clip joint lock 366 is inserted into the clip joint 364 to prevent the sidewalls from flexing inwardly, thereby preventing its removal.

The lower end of the pivot link 358 is pivotally mounted about the second axis 362 by a pivot rod 372, which passes through corresponding holes 374 through the pivot link 358. The ends of the pivot rod 372 are secured in the base 110 by mounting blocks 375, which are captured in or attached to the base 110, as described elsewhere herein.

Figure 3A:
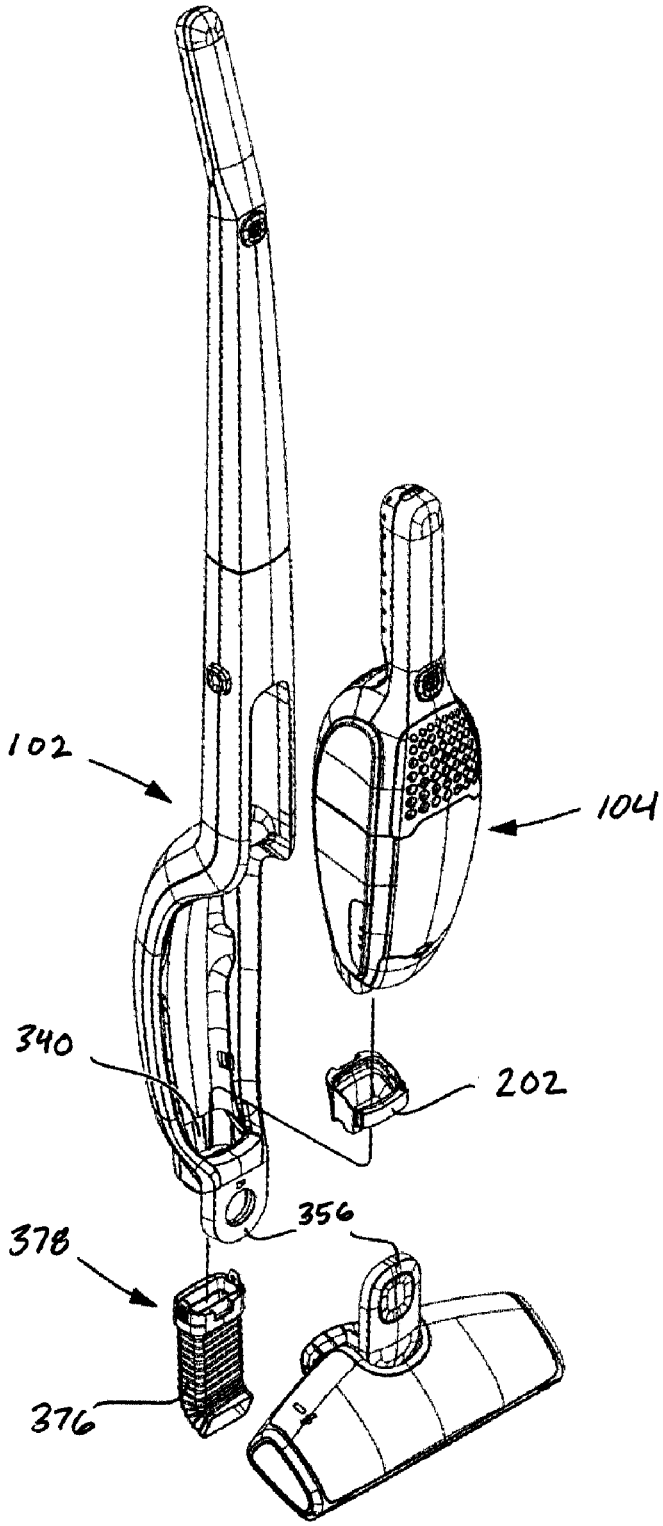
FIG. 3A is a partially exploded view of the vacuum cleaner of FIG. 1A.
Figure 3B:
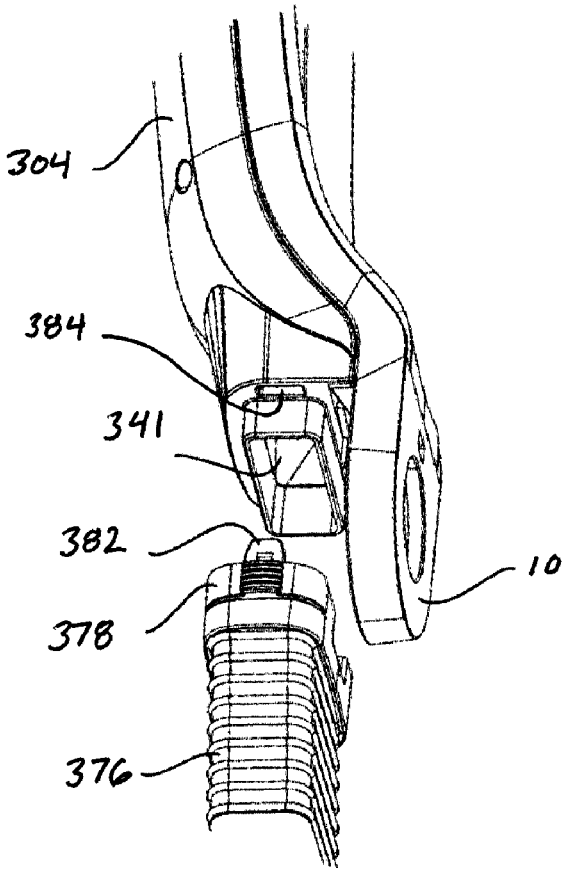
FIG. 3B is a fragmented, partially disassembled view of the hose and housing shown in FIG. 3.

Referring additionally to FIGS. 3A and 3B, located adjacent, and preferably behind, the pivot assembly 356 is a vacuum hose 376. The flexible hose 376 has a generally rectangular cross sectional shape, which allows it to be made with a comparatively large cross sectional area, but still be concealed behind the pivot assembly 356. This contributes to an attractive appearance of the vacuum cleaner while minimizing the air flow losses. It has been found that this shape maintains or improves airflow capacity over previous devices using oval or round hoses, without increasing the overall size of the device. It has been found, in one embodiment, that a cross sectional dimension of the air passages between 0.07-0.03 $dm^2$ is optimal for an air flow of 18 to 7 l/sec (liters per second). Furthermore, the rectangular shape is also capable of flexing and bending as the stick handle 103 moves and pivots relative to the base 110 without excessive occlusion of the hose 376.

Other non-ovate profiles, such as a triangular profile, may also be useful to provide high airflow while still maintaining a compact overall size, but the rectangular shape is preferred for the shown embodiment. Of course, the rectangular hose 376 is not strictly required of all embodiments of the invention, and it would also be possible to replace the flexible hose 376 with a conventional ovate hose, or a rigid conduit or series of conduits that pivot or rotate relative to one another to allow the base 110 to articulate relative to the stick handle 103.

Abrupt airflow path cross-section changes—such as enlargements, contractions, changes of cross-sectional shape, and tight turns—can restrict the airflow, cause it to slow down and reduce effectiveness, and cause clogging. In order to prevent abrupt flow path profile changes that might increase airflow losses, it is preferred for the airflow passage to remain generally rectangular (or to otherwise match the cross-sectional shape of the hose) downstream of the hose 376, at least for a short distance. To this end, the inlet conduit opening 202 and/or the openings 340, 341 through the lower handle 304 may also be formed with a generally rectangular shape to correspond to the shape of the hose 376. This may also be advantageous because using a rectangular airflow passage within the bodies of the lower handle 304 and handheld 104 may be a more compact, and possibly more desirable, design.

The vacuum hose 376 is attached at its upper end to a hose mount 378, which is attached to the bottom of the inlet conduit opening 202. As shown in FIG. 3B, the hose mount 378 may be attached to the housing 304 by tabs 382 that fit into corresponding slots 384 in the housing 304. These tabs 382 may be operated by a user to quickly release the hose 376 for inspection, and to remove any debris that may become stuck in the hose 376 and inhibit the airflow. Of course, the tab-and-slot arrangement can be modified or substituted by other releasable mechanisms.

Alternatively, the hose 376 may be mounted directly to the inlet conduit opening 202, or even captured in place or mounted in the lower handle 304 such that the handheld inlet 114 is inserted directly into the end of the hose 376. The vacuum hose 376, hose mount 378, and inlet conduit opening 202 provide an inlet air flowpath to the handheld inlet 114 when the handheld 104 is mounted to the stick assembly 102.

Figure 3C:
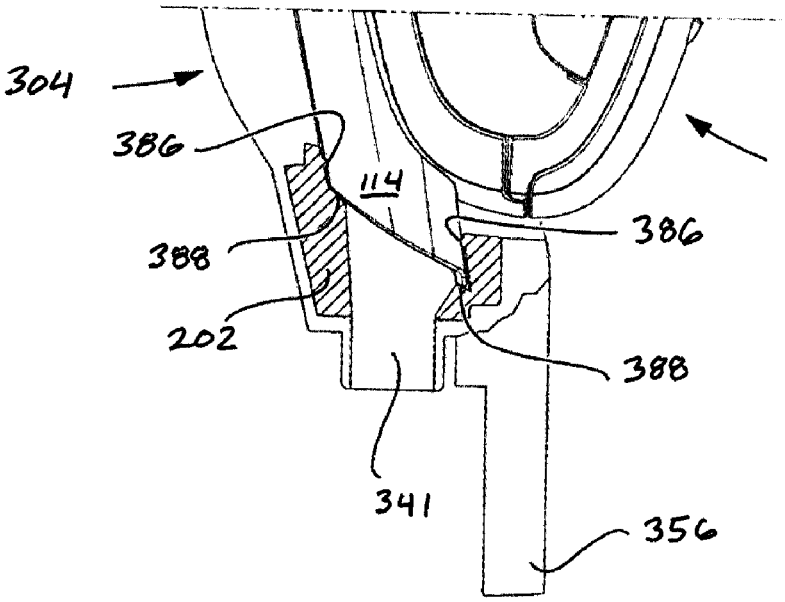
FIG. 3C is a partially cut away view of the vacuum cleaner of FIG. 1A.

Turning now to FIG. 3C, the airflow path from the hose 376, through the base housing 304, and into the handheld 104 is shown in more detail. Here, it can be seen that the handheld 104 is mounted in the mounting recess 112 (see FIGS. 1B and 2A) such that its inlet nozzle 114 is inserted into the inlet conduit opening 202. The inlet conduit opening 202 preferably is a resilient material that forms a generally airtight seal between the opening 341 to which the hose 376 is attached and the handheld inlet nozzle 114. To this end, the opening 202 is formed with a stepped shoulder portion 388 that abuts the end of the inlet nozzle 114. The opening 202 also may include a bead 386, that is adapted to bear against the outer surface of the inlet nozzle 114. This provides an adequate seal to restricts air leakage into the inlet nozzle 114. Such a bead 386 may unduly inhibit the insertion or removal of the handheld 104, and if this is the case, it may be formed with gaps or discontinuities to facilitate releasing and mounting of the handheld 104 into the handle 103. Such gaps preferably are located at the back of the opening 202 (i.e., the portion furthest back in the recess 112). In such a case, the front portion of the bead 386 should be sufficient to press the inlet nozzle 114 against the back surface of the opening 202 to form a sufficient air seal. Of course, other sealing arrangements may be used, such as replacing the bead 386 and shoulder 388 with separate gaskets, o-rings, or the like.

Figure 6:
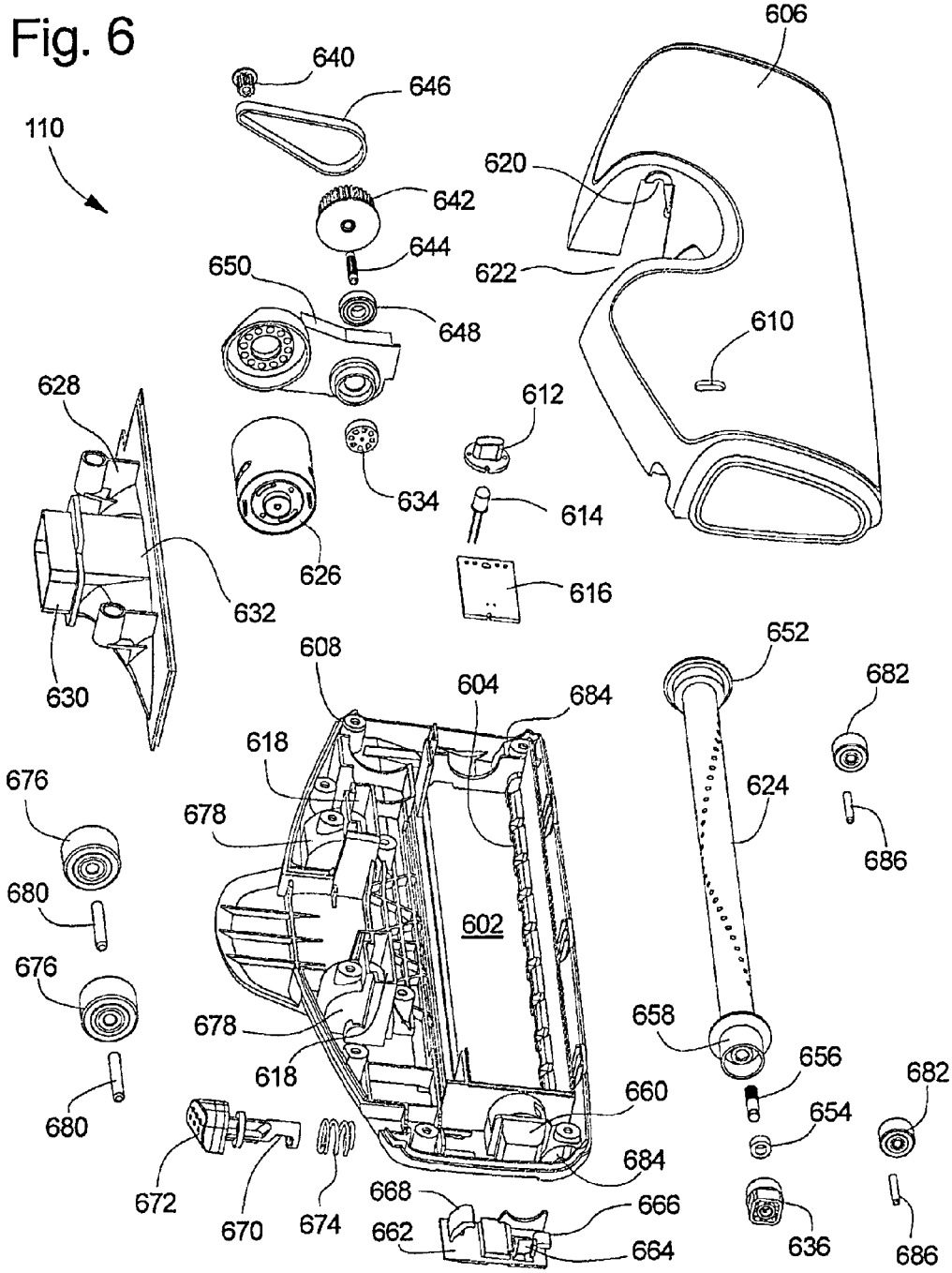
FIG. 6 is an exploded isometric view of the nozzle base of FIG. 1A.

Referring now to FIG. 6, the details of the vacuum cleaner base 110 are shown and described in detail. The base 110 is provided to support the stick vacuum 100 as it is moved across a surface being cleaned. An air inlet 602 is formed in the bottom of the base 110 and is fluidly connected to the vacuum hose 376 to form a portion of the inlet air flowpath. Various additional features, such as sweepers, airflow-increasing notches 604, skirts, and the like may be located around the air inlet 602, as known in the art. The base 110 preferably includes rolling devices or low-friction sliding surfaces to assist with moving across a surface being cleaned. In the shown embodiment a pair of rear wheels 676 are mounted in rear wheel housings 678 by respective wheel axles 680, and a smaller pair of front wheels 682 are mounted in front wheel housings 684 by respective axles 686. In addition, the base 110 may be removable such that the device can be operated without it, as may be desired when cleaning in tight spaces.

The base 110 preferably is formed by upper and lower base housing shells 606, 608, which generally contain and protect the working parts, if any are provided. In addition, the upper and lower base housing shells 606, 608 capture and hold the pivot rod mounting blocks 375 (FIG. 3), to pivotally retain the lower end of the pivot link 358 (FIG. 3) in place. In the shown embodiment, the pivot rod mounting blocks are positioned on top of mounting posts 618 located above the wheel housings 678, and the pivot rod 372 passes through notches 620 located in the upper base housing shell 606. The bottom of the pivot link 358 thus is able to pivot within a concave space 622 located at the back of the base 110.

The upper base housing shell 606 preferably provides a low-profile, aesthetically pleasing shape formed of a non-marking material or having a non-marking bumper formed around its perimeter to prevent marking objects it contacts during use. An opening 610 is formed in the upper base housing shell 606 to receive a lens 612, which covers a status light 614. The status light 614, in turn, is connected to a circuit board 616, which is used to control the operation of the status light 614 to provide the user with feedback regarding the operation of the device. For example, the status light 614 may be off when the device is off, turn green when a brushroll 624 mounted within the base 110 is operating, and turn red when the brushroll 624 stops unexpectedly, such as may happen if it becomes locked during operation and trips a circuit breaker (not shown) protecting the brushroll motor 626. The status light 614 preferably comprises a light emitting diode ("LED"), which is relatively vibration resistant and preferred for potentially high-impact uses, but it may comprise any other type of light of indicating device. In addition to the status light 614, one or more headlights may be provided in the base 110 to illuminate the surface being cleaned.

As noted above, the air inlet 602 is fluidly connected to the vacuum hose 376, which may be done by way of an intermediate manifold 628. The manifold 628 comprises a flared conduit that extends from a hose mounting flange 630 to which the hose 376 is connected, to a relatively wide opening 632 located adjacent the air inlet 602. The manifold 628 abuts the upper base housing shell 606 along its top edge, and together the manifold 628 and upper and lower base housing shells 606, 608 form an air flow path from the air inlet 602 to the vacuum hose 376. The manifold 628 may be formed integrally with, or formed by, one or both of the base housing shells 606, 608, or may be provided as a separate part that is captured in place between the shells 606, 608, as shown. When assembled, the hose mounting flange 630 is located in the concave space 622 at the back of the base 110, and positioned below the pivot link 358. With this configuration, sufficient clearance should be provided between the pivot link 358 and the hose 376 to allow the pivot link 358 to move within the space 622 without rubbing against or significantly pinching the vacuum hose 376.

Figure 7:
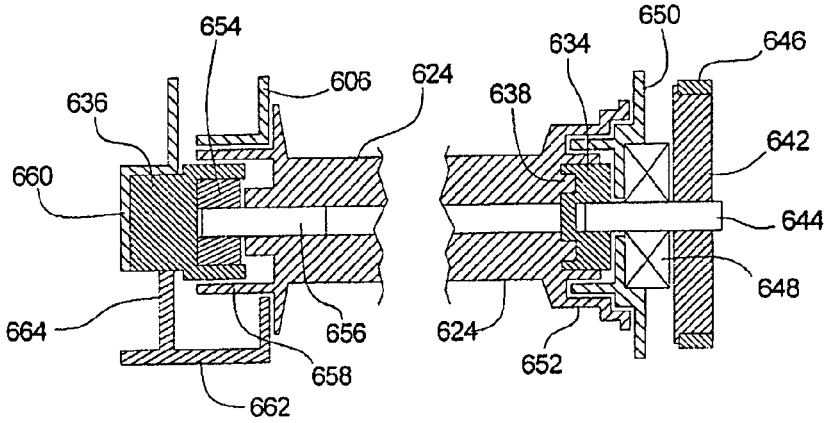
FIG. 7 is a schematic front view of the removable brushroll of the embodiment of FIG. 1A.

If desired, a brushroll 624 may be mounted above the air inlet 602 such that its bristles (not shown) protrude through the inlet 602 to agitate a surface to be cleaned. Any of the many different brushrolls and brushroll mounting arrangements known in the art may be used, but in the preferred embodiment, the brushroll 624 is mounted by a release system that allows a user to quickly remove the brushroll 624 to remove dirt or objects that are trapped in the inlet 602 or wrapped around the brushroll 624, or for other maintenance. Referring now to FIGS. 6 and 7, in a preferred arrangement, the brushroll 624 is mounted at one end to a drive plate 634, and at the other end to a mounting block 636. The mounting block 636 is releasably mounted, as described below, so that the brushroll 624 can be easily detached from the drive plate 634 and removed from the base 110.

The drive plate 634 is driven by a brushroll motor 626. In a preferred drive arrangement, a drive gear 640 is attached to the motor 626, and a driven gear 642 is attached to the drive plate 634 by a stub shaft 644. A drive belt 646 interconnects the gears 640, 642. The stub shaft 644 is pressed into or splined to both the driven gear 642 and the drive plate 634, and is rotatably mounted to the base 110 by a bearing 648. While the bearing 648 may be directly mounted to the upper and/or lower base housing shell 606, 608, more preferably it is indirectly mounted to the base 110 by way of a brushroll motor bracket 650. The brushroll motor bracket 650 is a separate, relatively rigid part that attaches to the drive plate bearing 648 and the motor 626 to hold them in proper alignment, which may help increase belt life 646. Such a construction is described in greater detail on co-pending U.S. patent application Ser. No. 11/191,948, filed on Jul. 29, 2005, which is incorporated herein by reference.

The drive plate 634 comprises a plurality of holes into which corresponding protrusions 638 (FIG. 7) on the end of the brushroll 624 fit. Of course, other arrangements that transmit torque from the drive plate 634 to the brushroll 624 may be used instead, such as a splined arrangement. Using this arrangement, the brushroll 624 can be quickly and easily removed from or attached to the drive plate 634. As best shown in FIG. 7, the brushroll 624 may also include various flanges 652 that form a labyrinthine path between the brushroll 624 and the bearing 648, and thereby help prevent the bearing 648 from being contaminated by dirt and debris.

The brushroll 624 is attached to the mounting block 636 by a bushing 654 (or bearing, if desired) that fits into a recess in the mounting block 636. The bushing 654 surrounds and rides on a second stub shaft 654 mounted in the end of the brushroll 624. The end of the brushroll 624 may include a shroud 658 that fits over the mounting block 636 to help isolate the bushing 654 from dirt and debris. When installed, the mounting block 636 fits within a recess 660 formed in the lower base housing shell 608. The mounting block 636 is secured in the base 110 by a mounting block retainer 662 that includes a clamping post 664 that presses the mounting block 636 into the recess 660.

Figure 8A:
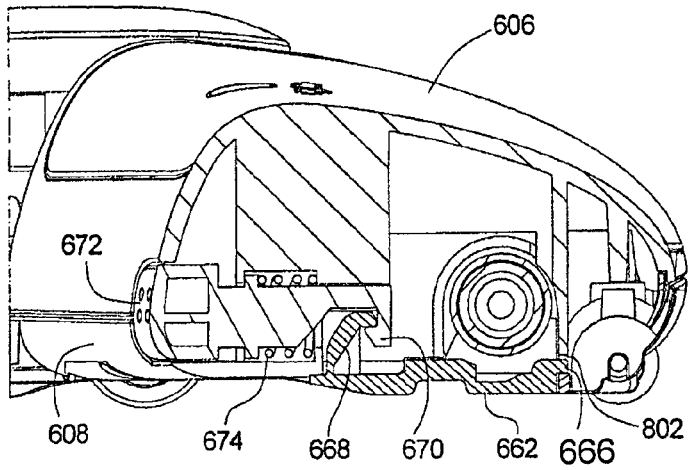
FIGS. 8A and 8B are cutaway side views of the nozzle base of FIG. 1A, showing the brushroll removal mechanism in the latched and unlatched positions, respectively.
Figure 8B:
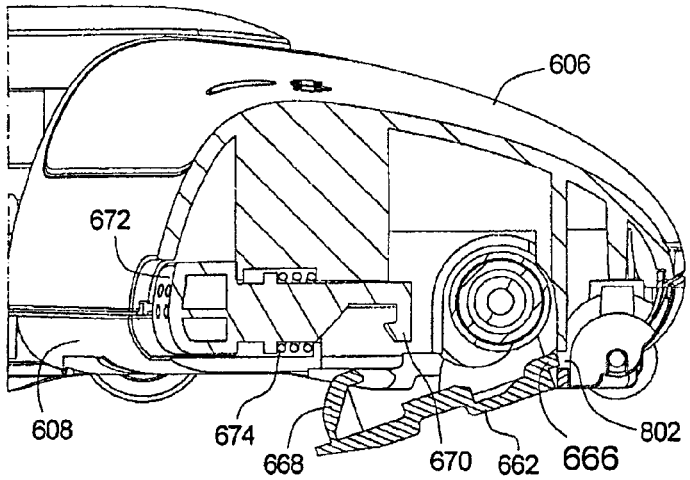

The operation of the mounting block retainer 662 is illustrated in FIGS. 8A and 8B. The mounting block retainer 662 includes a tab 666 that fits into a corresponding opening 802 in the base 110. With the tab 666 in place, the retainer 662 is pivoted upwards to press the mounting block 636 into the recess 660. When fully installed, a catch 668 located at the end of the retainer 662 opposite the tab 666 is engaged by a hook 670 provided on a moveable brushroll retainer button 672. The button 672 is biased by a spring 674 into the engaged position. To release the brushroll 624, the user presses the brushroll retainer button 672 to release the hook 670 from the catch 668. The brushroll 624 can then be removed by withdrawing the mounting block 636 from the recess 660 and pulling the other end of the brushroll 624 out of engagement with the drive plate 634. Installation is done by reversing the above process.

Figure 9:
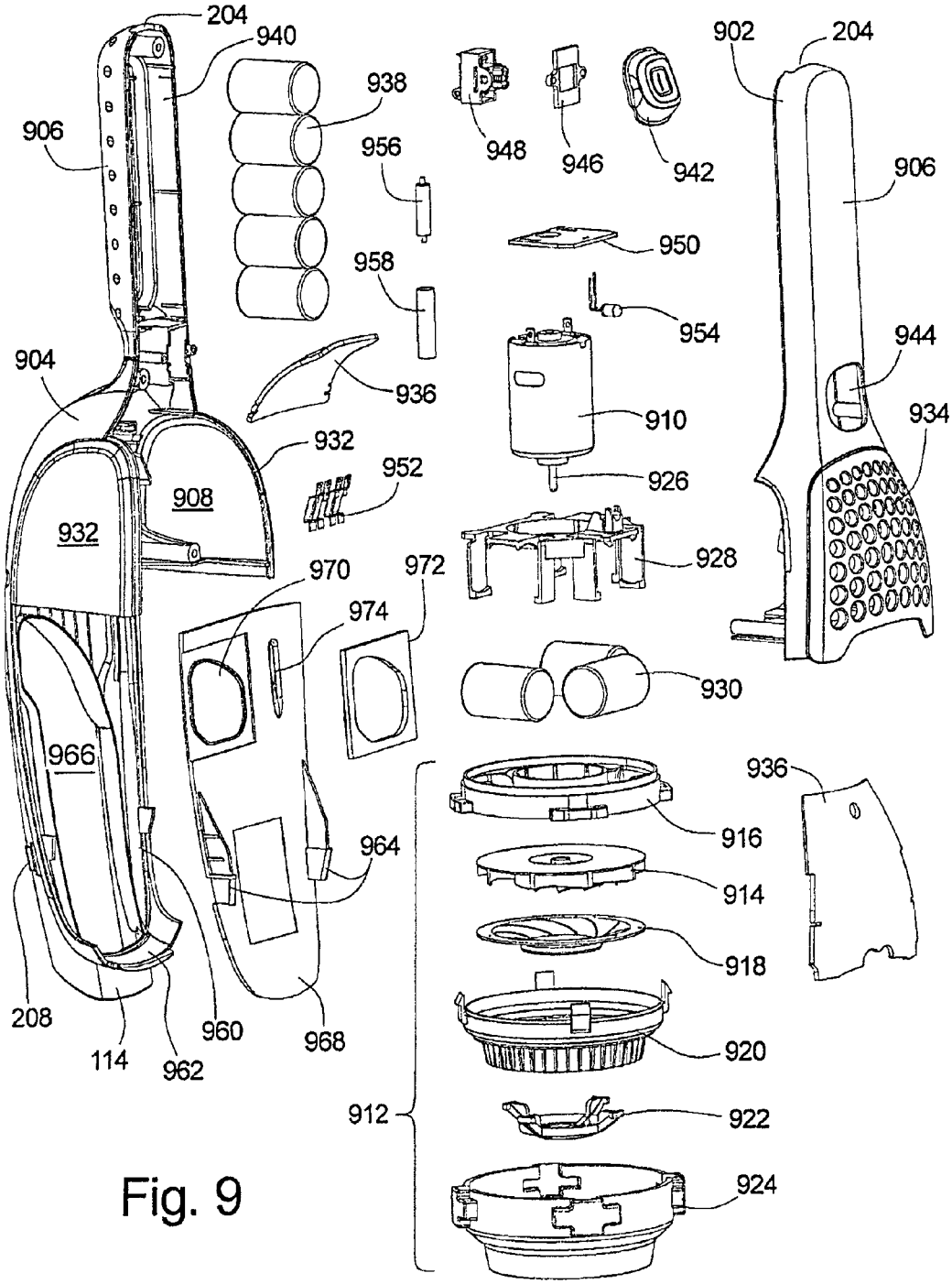
FIG. 9 is an exploded view of the handheld portion of the stick vacuum of FIG. 1A, shown without the dirt collection assembly.

Turning now to FIG. 9, an embodiment of the handheld vacuum cleaner 104 that may be used in conjunction with the foregoing stick assembly 102 or as a separate device is illustrated and described in detail. While the embodiment of the handheld 104 described herein includes features to allow it to be used with the stick portion of the vacuum as part of a convertible vacuum cleaner, it will be appreciated that other embodiments of the handheld 104 and various inventive features described with reference to the handheld 104 may be used outside the context of a convertible stick vacuum. The handheld 104 generally comprises upper and lower handheld housing shells 902, 904 that form a hand grip 906, a motor housing 908, and a dirt cup receiving area 960. As explained previously herein, the handheld 104 also includes an inlet nozzle 114 that preferably protrudes from the handheld 104 to help hold the handheld in the stick assembly 102. If other hooks or mechanisms are provided to mount the handheld 104 in the stick assembly 102 (or if the handheld 104 is not intended for use in combination with a stick assembly 102), the inlet nozzle 114 may instead be flush with the housing exterior. It is also anticipated that the inlet nozzle 114 can comprise an extendible nozzle, as known in the art.

Figure 9A:
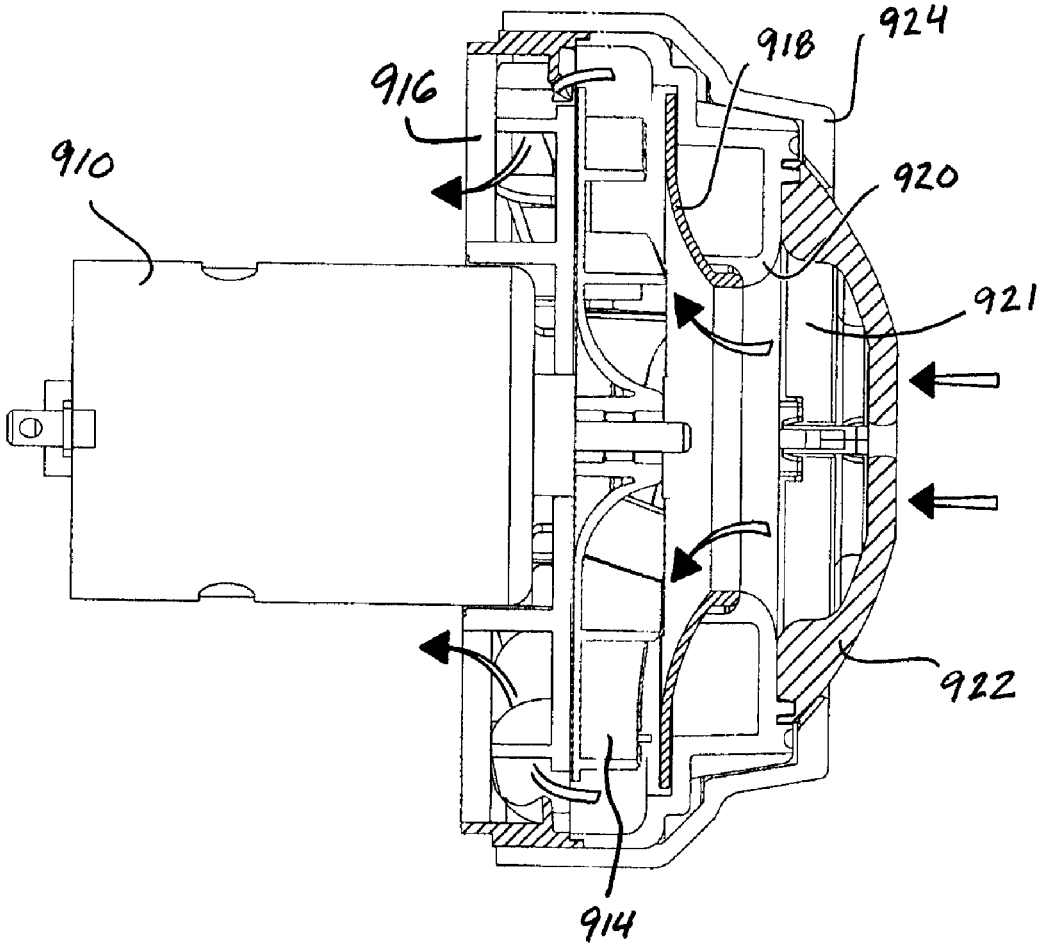
FIG. 9A is a partially cut away view of the motor and fan assembly of FIG. 9.

Referring now also to FIG. 9A, a fan motor 910 and fan assembly 912 are encased between the upper and lower handheld housing shells 902, 904 within the motor housing 908. The fan motor 906 drives the fan assembly 912 to provide suction to clean floors and other surfaces, as known in the art. In a preferred embodiment, the fan assembly 912 comprises a fan impeller 914 encased between an air diffuser 916 and an impeller cover 918. The cover 918 directs incoming air into the center of the impeller 914 and may include other features, such as contours or fixed vanes, to help improve performance. The diffuser 916 redirects air exiting the impeller 914 to help cool the motor 910. An inlet cover 920 encases the impeller 914 and impeller cover 918 and attaches them to the diffuser 916, and has an inlet hole 921 that forms the inlet to the fan assembly 912. The inlet hole 921 preferably is formed with a smoothly rounded, tapering funnel shape that smoothly mates with a smoothly rounded, widening portion of the impeller cover 918 to avoid unnecessary turbulence as the air enters the impeller 918.

A grille 922 is attached to the inlet cover 920 to prevent large objects from entering the impeller 914. Preferably, the grille 922 has a domed shape. This provides two potential benefits. First, the three-dimensional shape helps increase the total area of the flow openings through the grille 922. Second, the domed shape also makes the grille 922 stronger with respect to forces acting perpendicular to the fan assembly 912. This additional strength permits the individual ribs that form the grille 922 to be made narrower, thereby further increasing the total area of the flow openings.

The fan assembly 912 is encased by a fan cover 924, which may be provided as a somewhat resilient thermoplastic material, to protect the fan assembly 912 and hold it in place in the handheld 104.

The fan motor 910 is mounted to the fan assembly 912 with the motor's drive shaft 926 attached to the impeller 914. In a preferred embodiment, a battery bracket 928 is mounted around the fan motor 910 to hold a number of batteries 930 around the motor's peripheral wall. The diffuser 916 may also cool these batteries 930 during operation. In the shown embodiment, the batteries 930 are cylindrical and oriented with their cylindrical axes perpendicular to the rotational axis of the fan motor 910. In other embodiments, one or more of the batteries 930 may instead be oriented with its cylindrical axis parallel to the rotating axis of the motor 910, or at other angles that may be desirable to fit the batteries 930 in the handheld 104, to provide a more compact construction, or to provide other benefits.

As noted above, the assembled motor 910 and fan assembly 912 are installed in the motor housing 908 portion of the handheld 104. The motor housing 908 preferably is located immediately adjacent the hand grip 906 to improve the weight balance of the vacuum cleaner. The motor housing 908 is formed by the upper and lower handheld housing shells 902, 904, as well as a pair of inserts 932 that form the sides of the motor housing 908. Of course, the inserts 932 may be replaced by integral moldings on one or both of the housing shells 902, 904. The fan cover 924 fits tightly within the motor housing 908 to support the fan assembly 912 and motor 910, and may be made of a vibration-reducing material to reduce operating noise and vibrations. If the fan cover 924 is not sufficient, alone, to mount the fan assembly 912 and motor 910, additional mounts may be provided, as will be appreciated by those of ordinary skill in the art. The working airflow exits the motor housing 908 through one or more vent holes 934. One or more foam or elastic pads 936 may be provided within the motor housing 908 to reduce noise and/or vibrations generated by the fan assembly 912 and motor 910. One of these pads 936 preferably is located adjacent the vent holes 934 to inhibit viewing of the motor 910 and prevent objects from being ejected through the vent holes 934 should the motor experience a catastrophic failure. This pad 936 may also filter air exiting the motor housing 908, or a separate post-motor filter may be provided to filter the exhaust air, if desired.

As noted above, several batteries 930 may be arranged around the motor 910 to power the device. Batteries may also be located elsewhere in the handheld 104. For example, additional batteries 938 may be stored in a chamber 940 in the grip 906 or elsewhere in the device. The batteries 930, 938 are provided to power the fan motor 910, and such operation is controlled by a handheld switch actuator 942 that projects through an opening 944 through the upper handheld housing shell 902. The switch actuator 942 abuts against a switch cover 946, which, in turn, is arranged to operate an electric switch 948. Of course, other switch arrangements may be used, as will be appreciated by those of ordinary skill in the art.

The electric switch 948 selectively connects the batteries 930, 938 to the fan motor 910 to turn it on and off. In a preferred embodiment, the electric switch 948 has three positions: a power off position in which the motor 910 is inoperative, a partial power position in which the fan motor 910 is driven at a reduced power or speed, and a full power position in which the motor 910 is driven at a maximum operating capacity. Such operating states may be provided, for example, by wiring the electric switch 948 to connect a portion of the batteries 930, 938 to the motor 910 to provide reduced power operation, and to connect all of the batteries 930, 938 to the motor 910 to provide full power operation. A printed circuit board 950 or other control circuits may be used to assist with such control of the motor 910 and/or charging the batteries 930, 938.

In the shown embodiment, which is driven by rechargeable batteries 930, 938, the handheld 104 includes electrical contacts 952 to charge the batteries. When the handheld 104 is stored in the stick assembly 102, the electrical contacts 952 abut a corresponding electrical contact terminal 338 in the stick assembly 102 to receive power from an outlet or other source to charge the batteries 930, 938. In this position, the handheld 104 may also receive additional battery power from batteries (not shown) stored in the stick assembly 102. In an alternative embodiment, the electrical contacts 952 may be adapted to receive an input plug directly from a wall charger, or may be omitted if non-rechargeable batteries are used.

The handheld 104 of the shown embodiment may also include other electrical devices. For example, a light 954 is provided to illuminate the handheld switch actuator 942 during charging and/or use. LEDs are preferred for this application, as they are vibration resistant and draw relatively little power. An additional light or lights (not shown) may also be positioned on the handheld 104 to illuminate a surface being cleaned. In addition, a fuse 956 or circuit breaker (not shown) may be provided in the handheld 104 (or the stick assembly 102) to protect the fan motor 910 or other electrical components during use and/or charging. In a preferred embodiment, the fuse 956 is provided in a protective sheath 958, such as a PVC tube, but this is not required.

The handheld 104 also includes a dirt cup receiving area 960 located between the inlet nozzle 114 and the motor housing 908. The dirt collection assembly 1000 (FIG. 10), an embodiment of which is described subsequently herein, fits into the receiving area 960, and is engaged by snap engagement, latches, or other known mechanisms. In the preferred embodiment, the dirt cup is retained between the fan cover 924 and a protruding surface 962 located near the inlet nozzle 114. The protruding surface 962 preferably is somewhat sloped so that it directs the dirt collection assembly 1000 towards the fan cover 924 as the dirt collection assembly 1000 is installed, which helps provide an airtight seal between the dirt collection assembly 1000 and the fan motor's inlet. A pair of cup hooks 964 are provided in the receiving area 960 to be engaged by corresponding latches 1002 (FIG. 10) on the dirt collection assembly 1000 to retain the dirt collection assembly 1000 in place. The operation of these latches 1002 is described in more detail subsequently herein. To further help with aligning and installing the dirt collection assembly 1000, the handheld 104 may include a receiving slot 974 that receives a corresponding protrusion 1104 (FIG. 11) of the dirt collection assembly 1000. Of course, the locations of the slot 974 and protrusion 1104 may be moved or reversed from the shown embodiment.

As shown in FIG. 9, the inlet nozzle 114 connects to a conduit 966 formed along the back portion of the dirt cup receiving area 960. The conduit 966 is enclosed by a conduit cover 968, which may be transparent to allow a user to see clogs in the conduit 966 and/or removable to allow access to the conduit 966. The conduit ends at a nozzle outlet 970 through the cover 968. The nozzle outlet 970 faces the dirt cup inlet 1004 (FIG. 10) when the dirt collection assembly 1000 is installed. A seal 972 of any suitable sealing material, such as foam rubber or the like, may be provided around the nozzle outlet 970 to help form an airtight seal against the dirt cup inlet 1004. Alternatively, the inlet nozzle 114 may be formed as part of the dirt collection assembly 1000. An embodiment of such an alternative construction is shown in U.S. Pat. No. 6,122,796, which is incorporated herein by reference, in which an inlet nozzle is provided at the end of the dirt collection assembly.

Figure 10:
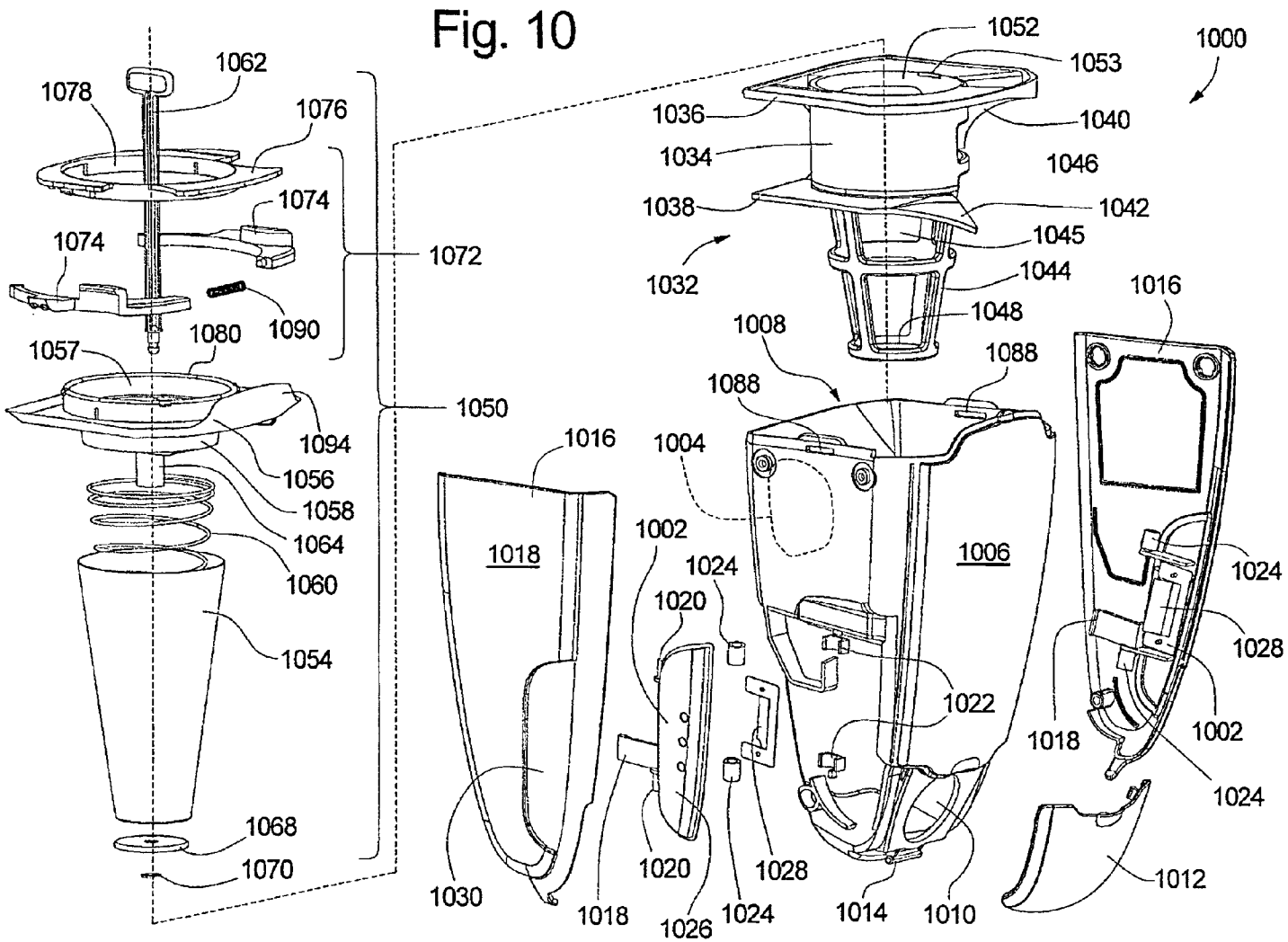
FIG. 10 is an exploded view of the dirt collection assembly of the handheld vacuum of FIG. 1A.

Turning now to FIG. 10, a preferred embodiment of a dirt collection assembly 1000 that may be used with the present invention is shown and described. The illustrated dirt collection assembly 1000 uses cyclonic separation principles in conjunction with particle filters to remove dirt and debris from the working airflow, but it will be appreciated that this is not strictly necessary for all embodiments of the invention. For example, the dirt collection assembly 1000 may instead comprise a conventional bag filter, planar filter and/or pleated filter, or may house a cyclone separator that does not use additional filters. The dirt collection assembly 1000 also may be permanently affixed to the handheld 104, in which case one or more access covers may be provided on the handheld 104 to clean out the dirt collection chamber and/or filter(s).

Figure 11:
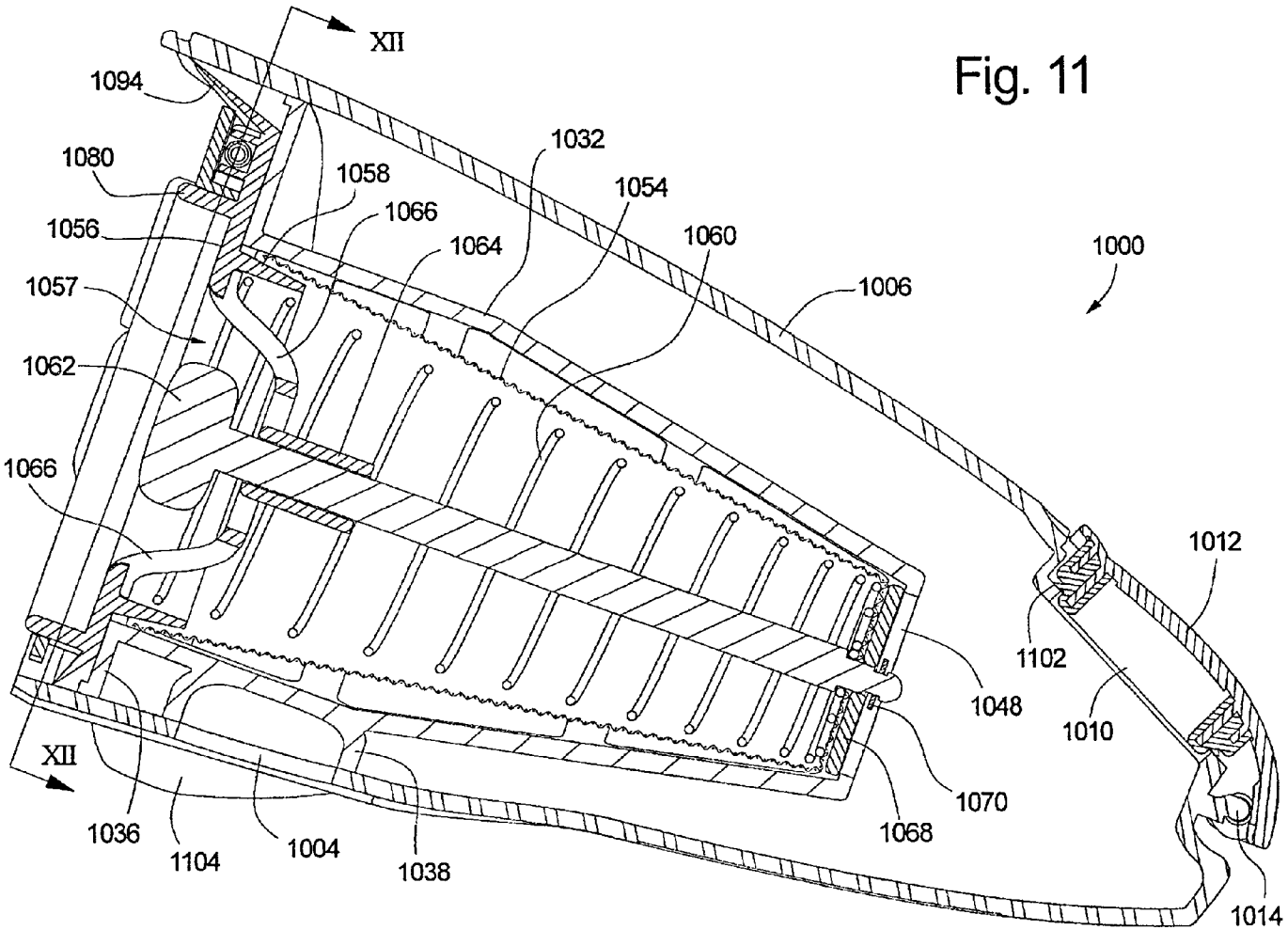
FIG. 11 is a cutaway side view of the dirt collection assembly of the handheld vacuum of FIG. 1A.

The dirt collection assembly 1000 comprises a cup-like dirt collection chamber 1006 having an open end 1008 that faces the fan cover 924 when it is installed in the handheld 104. The general profile of the dirt collection chamber 1006 is approximately rectangular with rounded corners, but a more circular profile may be used. The rectangular profile allows greater dirt-holding capacity without increasing the overall diameter of the handheld 104, and has been found to provide suitable cyclonic dirt separating performance. A dirt access port 1010 may be formed in the collection chamber 1006, as disclosed in U.S. patent application Ser. No. 10/544,927 (previously incorporated herein by reference). If such a port 1010 is provided, a suitable cover 1012 may be provided to cover the port 1010 when it is not in use. The cover may be fully removable, or rotatable about a pivot 1014, as shown. A suitable seal 1102 may be provided to seal the cover 1012 where it contacts the outer perimeter of the port 1010. As best shown in FIG. 11, in the shown embodiment the seal 1102 comprises a facing lip seal, but other seal configurations may be used instead. One or more resilient tabs (not shown) may be used to hold the cover 1012 in the sealing position, or the seal itself may be used by projecting it into the port 1010 to form an interference fit when the cover 1012 is closed.

Returning to FIG. 10, side panels 1016 are mounted on opposite sides of the dirt collection chamber 1006. The side panels 1016 have slightly indented or concave regions 1018 that facilitate gripping of the dirt collection assembly 1000. Cup latches 1002 are mounted between each side panel 1016 and the wall of the dirt collection chamber 1006. Each cup latch 1002 has a latch hook 1018 that is adapted to engage the corresponding cup hook 964 (FIG. 9) in the handheld dirt cup receiving area 960 (FIG. 9). The latches 1002 are mounted in a "see-saw" configuration in which each latch 1002 is pivotally mounted between the side panels 1016 and the collection chamber 1006 by a pair of pivots 1020 that fit in corresponding bosses 1022 on the collection chamber 1006 wall. Bushings 1024 may be provided to provide smooth and consistent pivoting action. Each latch 1002 is operated by a cup release button 1026 located on the opposite side of the pivots 1020 as the latch hook 1018. A leaf spring 1028 is mounted to the latch 1002 to bias the button 1026 away from the collection chamber wall, and to bias the latch hook 1018 into engagement with the corresponding cup hook 964. Using this configuration, the majority of the cup latching arrangement is concealed between the side panels 1016 and the dirt collection chamber 1006, but the cup release buttons 1026 are accessible through corresponding openings 1030 in the side panels 1016.

As noted above, the dirt collection assembly 1000 preferably operates using cyclonic separation and conventional dirt filtration to remove particles and debris from the working airflow. To this end, the dirt collection assembly inlet 1004 is located offset from the centerline of the dirt collection chamber 1006 so that the incoming airflow enters in a somewhat tangential direction to initiate the formation of a vortex within the dirt collection chamber 1006. Alternatively, the inlet 1004 may be on the dirt collection chamber centerline and a diverter (not shown) provided to redirect the airflow in a tangential direction. These and other cyclonic inlet configurations are known in the art.

Figure 10A:
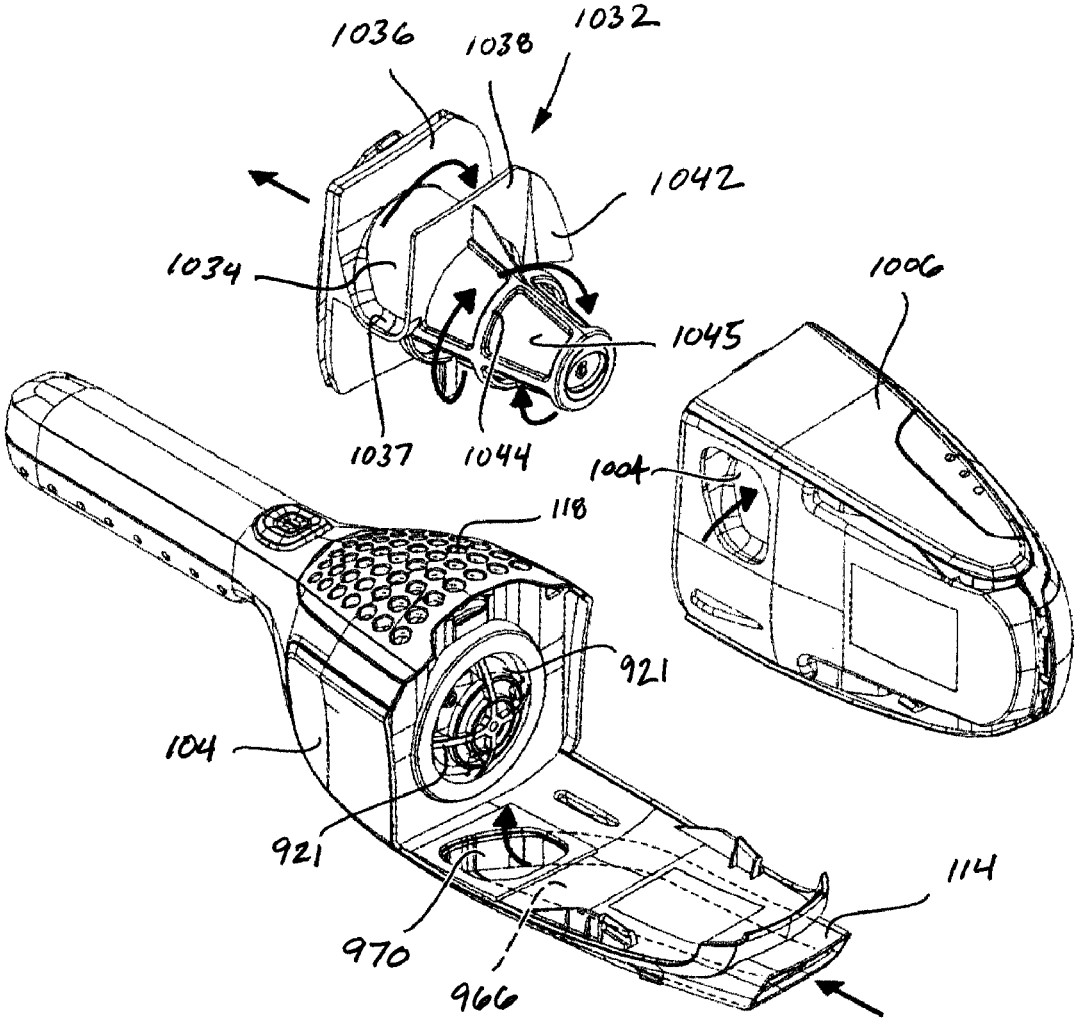
FIGS. 10A and 10B are partially exploded isometric views of the handheld vacuum of FIG. 1A.

Further assisting with the creation of a cyclonic separating effect is a cyclone insert 1032, which is releasably mounted in the dirt collection chamber as best shown in FIGS. 10 and 11. The cyclone insert 1032 (if provided) may comprise a structure as simple as a conical or frustoconical flat or pleated filter, or a simple air guide that helps guide the incoming airflow around the periphery of the dirt collection chamber 1006 to create and maintain cyclone separation. In a preferred embodiment, however, the cyclone insert 1032 comprises a structure that both directs the airflow in a cyclonic pattern, and provides a first filtration stage for the incoming airflow. Specifically, the cyclone insert 1032 comprises a cylindrical or frustoconical airflow receiving area 1034 (FIG. 10) through which the incoming airflow passes as it enters the dirt collection assembly 1000. The upper end of the airflow receiving area 1034 (that is, the end towards the open end 1008 of the dirt collection chamber 1006) is bounded by an upper radially-extending flange 1036 that fits relatively closely to the inner wall of the dirt collection chamber 1006. The lower end of the airflow receiving area 1034 may be provided with a similar lower radially-extending flange 1038 that extends partially around the receiving area 1034 to contain the incoming airflow within the receiving area 1034 for a time before being deposited into the remainder of the dirt collection chamber 1006. One end of the airflow receiving area 1034 preferably is blocked by a wall 1037 (FIG. 10A) extending between the upper and lower flanges 1036, 1038, which helps prevent the air from flowing in the "wrong" direction, but is not strictly necessary. The airflow receiving area 1034 wraps partially around the cyclone insert 1032, and preferably terminates at a first downward ramp 1040 that extends into the dirt collection chamber 1006 from the upper flange 1036. A second downward ramp 1042 or lip may also be provided at the end of the lower flange 1038. The first downward ramp 1040 helps direct the incoming airflow into the portion of the collection chamber 1006 below the lower flange 1038, and the second downward ramp 1042 drives circulating air already below the lower flange 1038 further down into the dirt collection chamber 1006 to enhance dirt separation. Both of these ramp features may improve the airflow efficiency of the device.

Figure 13B:
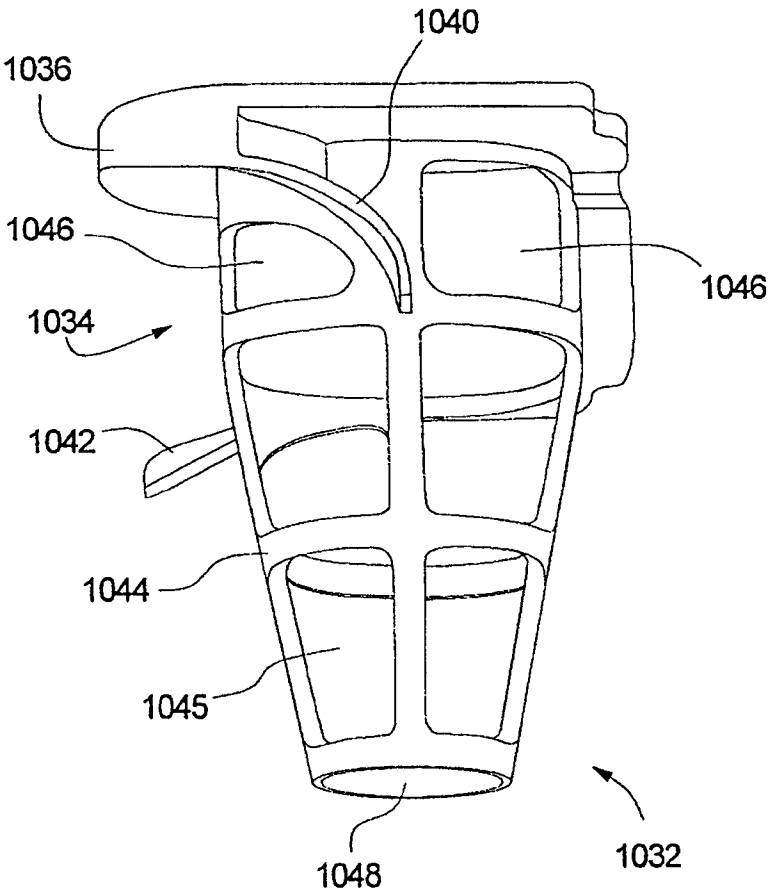
FIGS. 13A and 13B are isometric views of the cyclone insert of the dirt collection assembly of FIG. 10, shown with the coarse screen filters removed.
Figure 13A:
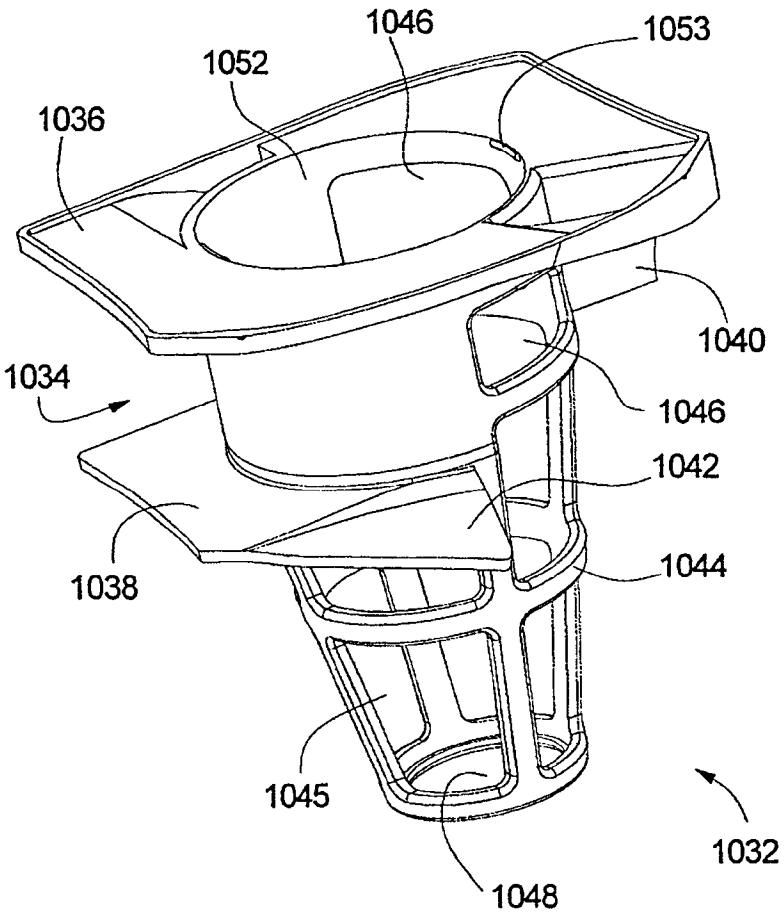

Referring now to FIGS. 13A and 13B, extending below the airflow receiving area 1034 is a cylindrical or, more preferably, frustoconical filter cage 1044. The filter cage 1044 includes a number of large openings 1045 through its sidewall, in which appropriate mesh screens (not shown) are placed, such as by overmolding, to provide a coarse particle filtration stage. Such filter cages and screens are known in the art. In order to provide even greater surface area for coarse particle filtration, the cyclone insert 1032 may have additional openings 1046 (with corresponding screens) through the upper wall that forms the airflow receiving area 1034. In the shown embodiment, a lower opening 1048 is also provided through the bottom of the filter cage 1044. In embodiments in which the device includes a fine particle filter located within the cyclone insert 1032, such as described below, the lower opening 1048 may optionally remain fully open (i.e., does not have a screen over it) to thus allow dirt from the fine particle filter to be deposited into the dirt collection chamber 1006.

Figure 10B:
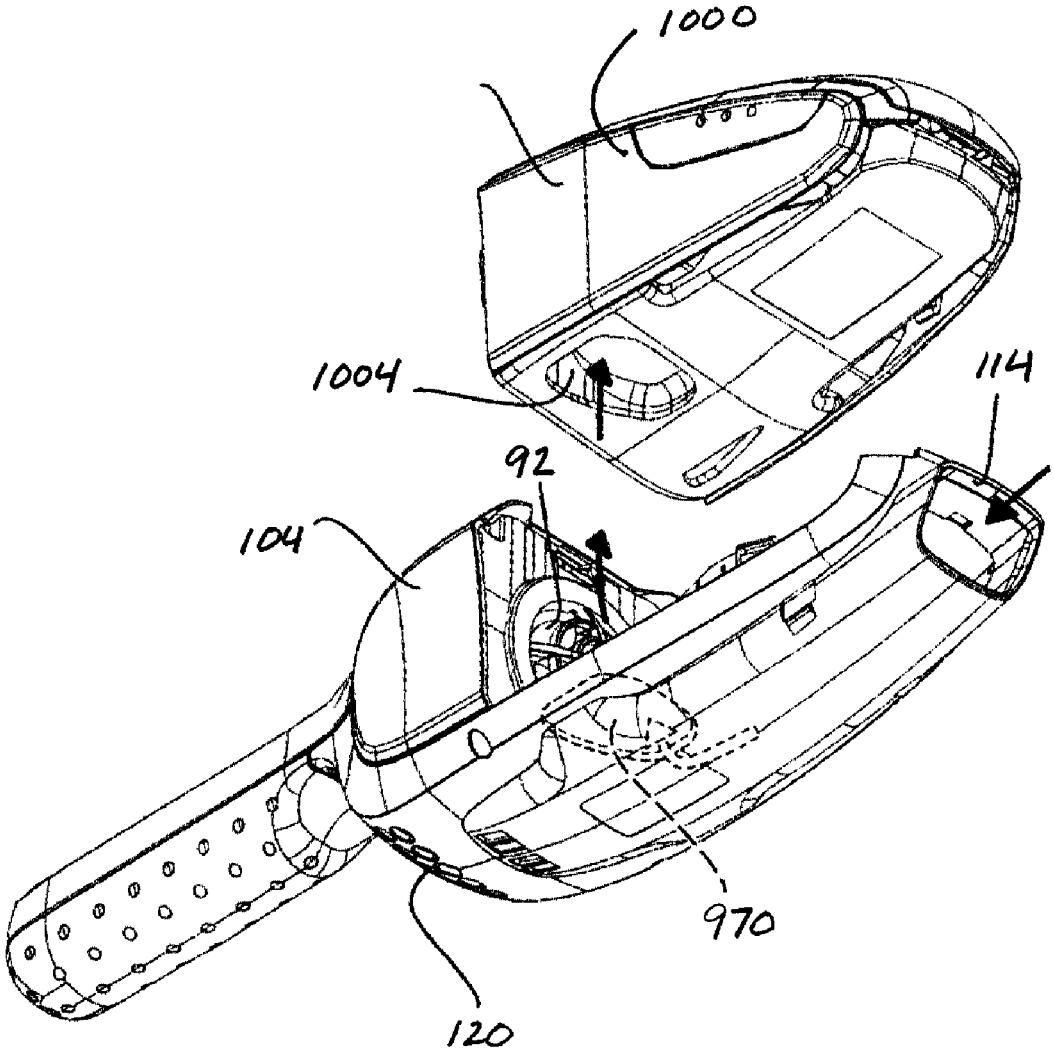

Turning now to FIGS. 10 through 10B, the connection of the dirt collection assembly 1000 to the rest of the handheld 104 is shown. The dirt collection assembly 1000 mounts to the handheld 104 such that the dirt cup inlet 1004 mates with the outlet 970 of the inlet nozzle 114. The conduit 966 between the inlet 114 and outlet 970 is shown in broken lines. When the dirt collection assembly 1000 is mounted, the open end, into which the cyclone insert 1032 is fitted, abuts the fan assembly inlet hole 921.

The conduit 966 preferably is formed with a somewhat curved shape that redirects the air entering the inlet 114 to flow somewhat tangentially into the dirt collection chamber 1006. To assist with this, the outlet 970 is positioned off-center with respect to the symmetrical centerline of the handheld 104. This shape of the conduit 966 and other parts preferably are contoured to minimize any turbulence caused by redirecting the airflow into the dirt collection chamber 1006.

Figure 10C:
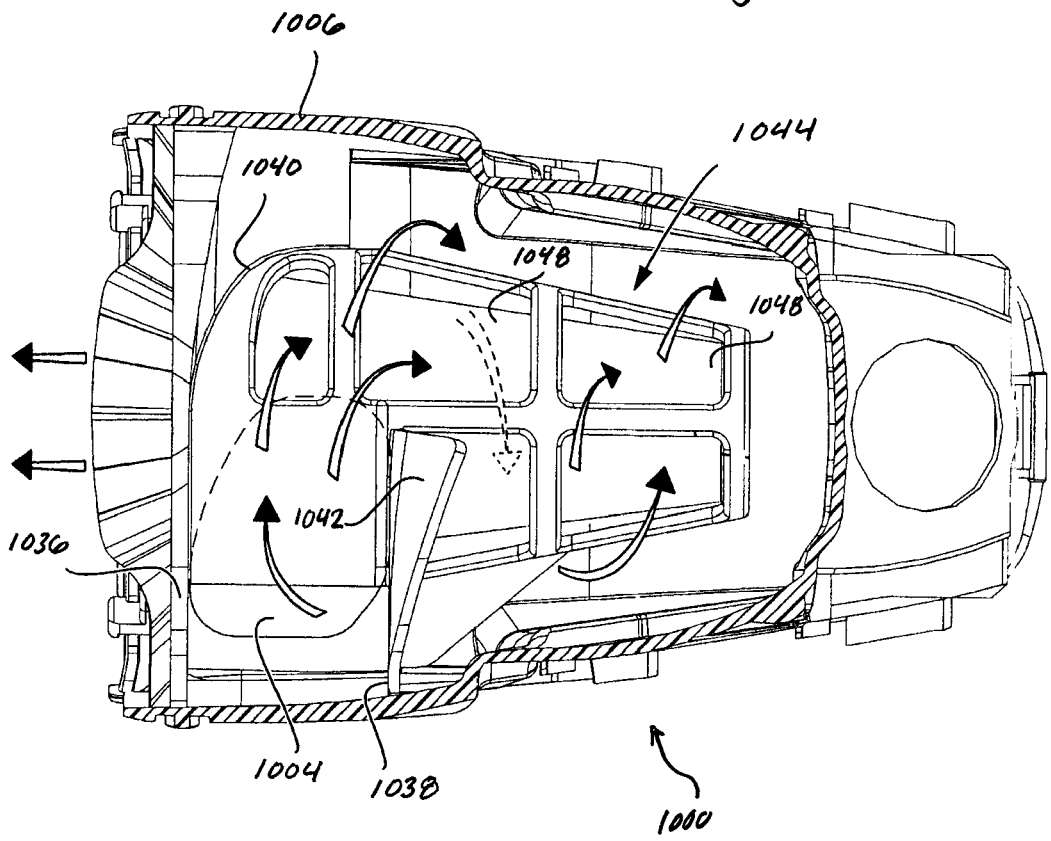
FIG. 10C is a partially cut away top view of the dirt collection assembly of the handheld vacuum of FIG. 1A.

Referring to FIG. 10C, the airflow within the dirt collection assembly 1000 is shown. Here, the various flanges and other structures (e.g., 1036, 1038, 1040, 1042) of the cyclone insert 1032 are shown directing the incoming air in a swirling motion within the dirt collection chamber 1006, as shown by the arrows. As the air flows helically around the cyclone insert 1032, it gradually enters radially through the openings 1048 and subsequently flows in the axial direction inside the cyclone insert 1032 to the fan assembly 912.

Turning now to FIGS. 10 and 11, the dirt collection assembly 1000 of a preferred embodiment also includes a fine particle filter assembly 1050 that can be releasably inserted into an open upper end 1052 of the cyclone insert 1032 to fit within the insert. The fine particle filter assembly 1050 may comprise a simple fabric or pleated filter that is designed to capture fine particles than may pass through the coarse filter meshes of the cyclone insert 1032, as known in the art. In a preferred embodiment, the fine particle filter assembly 1050 comprises a flexible filter that can be repeatedly retracted and extended to remove entrapped particles from its surface.

In the embodiment illustrated herein, the fine particle filter assembly 1050 comprises a frustoconical flexible filter 1054 mounted to a sealing flange 1056, and a mechanism for retracting and extending the flexible filter 1054 to clean the filter. The fine particle filter assembly 1050 may fit wholly or partially within the cyclone insert 1032. If desired, snap tabs 1053, hooks, bayonet fittings, threads or other attachment devices may be provided to hold the fine particle filter assembly 1050 in the cyclone insert. It will also be appreciated that the fine particle filter assembly 1050 may be located adjacent or downstream of the cyclone insert without fitting therein.

The flexible filter 1054 preferably is mounted to a cylindrical or frustoconical protrusion 1058 that extends from the surface of the flange 1056. Such attachment may be by adhesives, stitching, overmolding or other suitable mechanisms or means, or combinations thereof. Other attachment arrangements may be used, but the foregoing arrangement attaches the flexible filter 1054 to the flange 1056 such that forces applied to extend the filter away from the flange 1056 are carried in shear, thereby potentially reducing the likelihood that the filter 1054 will become detached from the flange 1056. The flexible filter 1054 also may be removably attached to the flange 1056 by mounting the filter 1054 to a mounting collar (not shown), and providing mating attachment surfaces (such as bayonet fittings, snaps or threads) between the mounting collar and the sealing flange 1056. A flange opening 1057 passes through the center of the sealing flange 1056 to provide an airflow path out of the dirt collection assembly 1000. The frustoconical protrusion 1058 surrounds the flange opening 1057 such that air must pass through the flexible filter 1054 before exiting the dirt collection assembly 1000.

The filter retracting and extending mechanism comprises a snap spring 1060 located within the flexible filter 1054, and positioned to abut and extend from the sealing flange 1056 to bias the filter away from the flange 1056, as shown in FIG. 11. A spring handle 1062 is provided to pull the spring 1060 towards the flange 1056. The spring handle 1062 passes through and is supported by a cylindrical guide 1064, which is supported in the flange opening 1057 by inwardly-extending arms 1066. The snap spring 1060 is attached to the end of the spring handle 1062 by way of a disc-shaped end seal 1068, which is captured on the end of the handle 1062 by a snap ring 1070 or other attachment such as threads, press-fitment, or the like. The snap spring 1060 is thus captured between the end seal 1068 and the sealing flange 1056, and withdrawing the spring handle 1062 causes the snap spring 1060 to compress towards the flange 1056. When the snap spring 1060 is in the extended position, as shown in FIG. 11, the end seal 1068 seals the lower opening 1048 of the filter cage 1044. In this position, sufficient residual force preferably remains in the snap spring 1060 to prevent the end seal 1068 from being pulled out of sealing engagement over the lower opening 1048 by suction forces generated by the vacuum. However, the end seal 1068 and snap spring 1060 may be designed such that some air leakage though the bottom opening 1048 may be intentionally provided to allow air to pass to the flexible filter 1054 should the coarse filter screens become occluded.

As best shown in FIG. 11, the snap spring 1060 preferably is shaped to generally correspond with the shape of the flexible filter 1054 when it the snap spring 1060 is extended. In this manner, it can help support the flexible filter 1054 and prevent it from collapsing when a suction force is applied to generate the working airflow. The end of the flexible filter 1054 opposite the sealing flange 1056 is attached to one or both of the snap spring 1060 and the end seal 1068 by any suitable means, or may simply be captured between the end of the snap spring 1060 and the end seal 1068.

In operation, the user can pull and release the spring handle 1062 to compress and extend the snap spring 1060, respectively. Doing so causes the flexible filter 1054 to collapse and fold in on itself, which helps release dirt and debris that may be adhered to the flexible filter 1054 or embedded within the filter's surface. In addition, if the spring handle 1062 is released when the snap spring 1060 is compressed, the snap spring 1060 will rapidly extend to apply a sudden tension to the flexible filter 1054 to help release dirt and debris by the generation of sudden inertial forces in the filter surface. Each time the snap spring 1060 is compressed, dirt and debris blocked by the flexible filter 1054 can fall through the bottom opening 1048. If the fine filter assembly 1050 is still attached to the dirt collection assembly 1000, such released dirt will fall into the remainder of the dirt collection chamber 1006.

Figure 12:
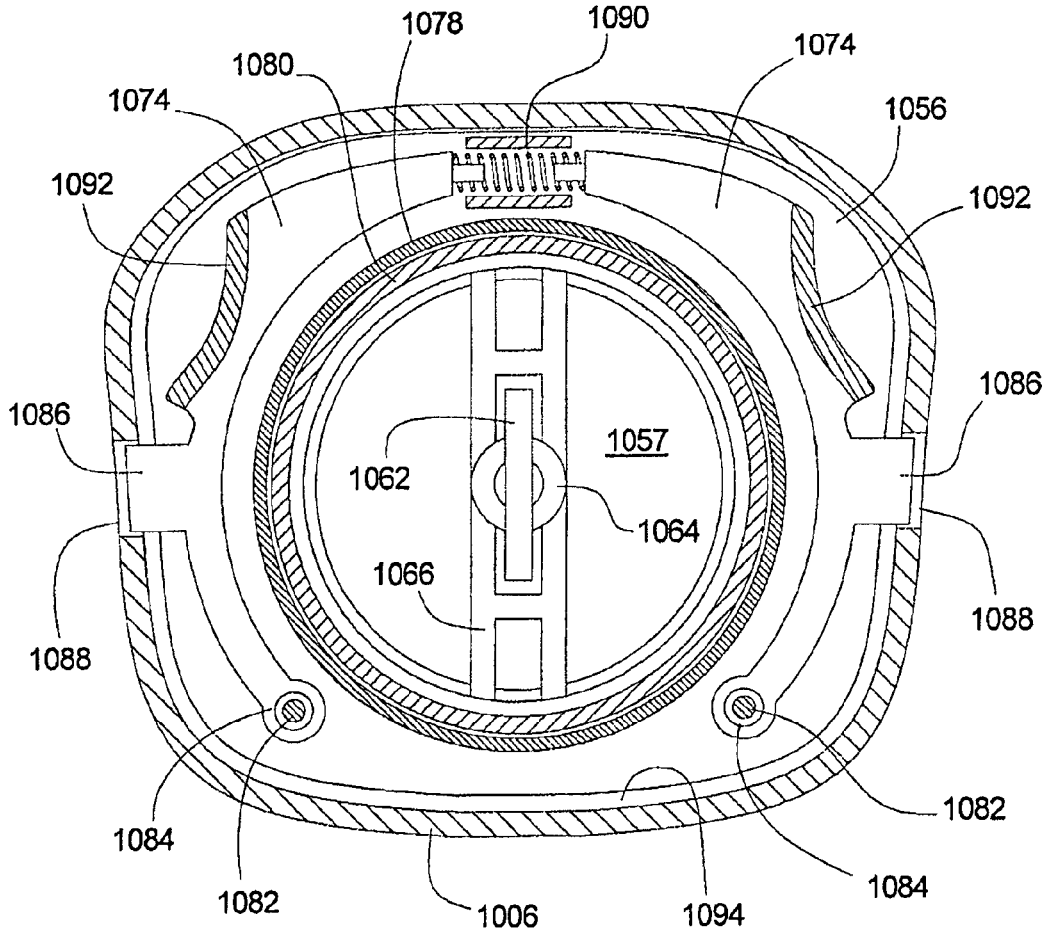
FIG. 12 is a cutaway top view of the dirt collection assembly of the handheld vacuum of FIG. 1A, as shown along line XII-XII of FIG. 11.

Referring now to FIGS. 10, 11, and 12, a preferred embodiment of the fine filter assembly 1050 also may include a retainer assembly 1072 (FIG. 11), which is provided to prevent the fine filter assembly 1050 from pulling free of the dirt collection chamber 1006 when the spring handle 1062 is pulled to compress the snap spring 1060. While any kind of latching system may be used, a preferred retainer assembly 1072 comprises a pair of release arms 1074 that are captured in place on the upper surface of the sealing flange 1056 by a support ring 1076. The support ring 1076 is attached to the sealing flange 1056 by a cylindrical collar 1078 that snaps over a corresponding cylindrical collar 1080 protruding from the sealing flange 1056. A pair of pins 1082 extend from the support ring 1076 towards the sealing flange 1056 to fit in corresponding holes 1084 at one end of each release arms 1074. In this way, the release arms 1074 are free to pivot within the space between the support ring 1076 and the sealing flange 1056. Each release arm 1074 has a radially-extending tab 1086 that is arranged to fit into a corresponding slot 1088 in the dirt collection chamber 1006, and a spring 1090 is located between the ends of the release arms 1074 opposite the pivot pins 1082 to bias the release arms 1074 and their tabs 1086 into the slots 1088. Finger tabs 1092 are provided on the release arms 1074 to allow a user to pull the release arms 1074 against the spring 1090 to release the tabs 1086 from the slots 1088 and remove the fine filter assembly 1050 from the dirt collection chamber 1006.

When the various parts of the dirt collection assembly 1000 are assembled, they provide a sealed dirt collection device that allows little or no air to leak into or out of the working airflow between the dirt cup inlet 1004 and the fan assembly 912 during normal operating conditions. As best shown in FIG. 11, this sealed arrangement is provided primarily by the sealing flange 1056, which includes a perimeter lip seal 1094 that seals against the inner wall of the dirt collection chamber 1006 when installed therein. In addition, the cylindrical collar 1080 to which the fine filter retainer assembly 1072 is attached is arranged to abut and/or surround the fan cover 924 to provide a seal between the dirt collection assembly 1000 and the fan assembly 912. Finally, the cyclone insert 1032 abuts a surface of the sealing flange 1056 to form a seal therebetween that prevents or inhibits air from bypassing the cyclone insert 1032. A facing lip seal or o-ring (not shown) may be provided between the sealing flange 1056 and the cyclone insert 1032 to improve the seal between these parts.

Various additional examples of such flexible filter assemblies or filter units are shown in FIGS. 11A-11G and are described below.

Figure 11A:
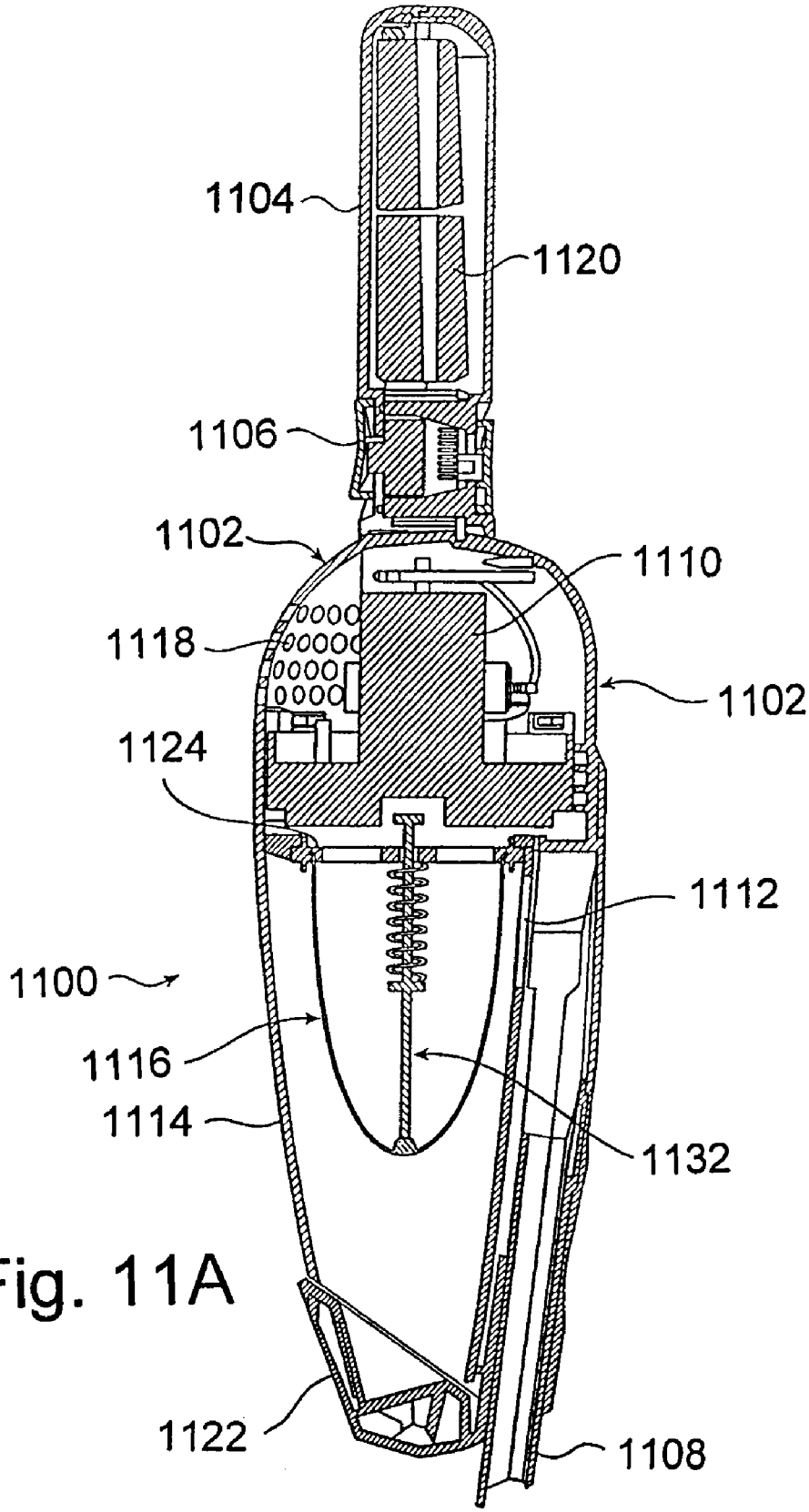
FIG. 11A is a cutaway side view of an alternate embodiment of the handheld vacuum of FIG. 1A.

Referring now to FIG. 11A an alternative embodiment of a handheld vacuum cleaner 1100 with various filter cleaning systems is illustrated. The vacuum cleaner 1100 comprises a housing 1102 having a handle 1104, an on/off-switch 1106 and an inlet 1108 for suction of dust laden air. The suction is generated by a motor fan unit 1110 arranged in the housing 1102. When the vacuum cleaner 1100 is operated, air flows from the inlet 1108 of the vacuum cleaner 1100, into an inlet opening 1112 of a dust container 1114, through a filter unit 1116, past the motor fan unit 1110, and the air exits the vacuum cleaner 1100 through outlets 1118.

As described in the other embodiments above, dust laden air flows through the filter unit 1116 during operation and the air is filtered by the filter unit 1116 which traps dust, fibers, hair, sand and other particles. Some of the vacuumed particles adhere to the filter unit 1116, but many are trapped in a lowermost part of the dust container 1114. The dust container 1114 is emptied, for example, by opening a lid 1122 belonging to the dust container 1114 and by allowing the dust to exit the lid opening, or by removing the dust container 1114 from the housing 1102 and allowing dust to escape from an opening 1124 of the dust container 1114.

Figure 11B:
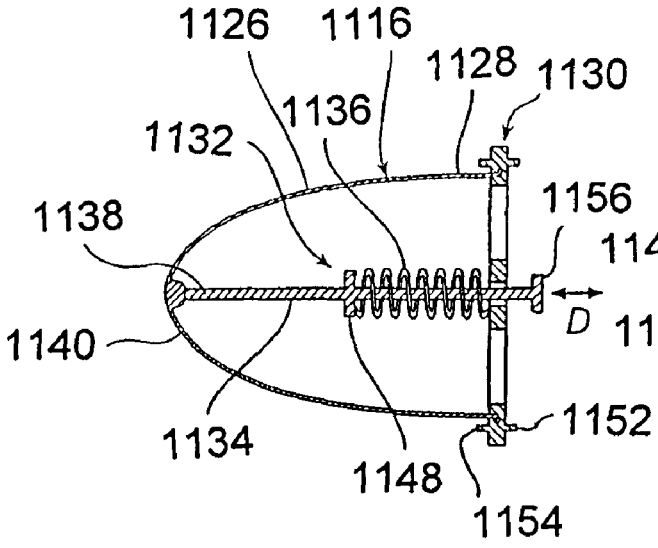
FIG. 11B is a cutaway side view of one embodiment of a filter unit of the handheld vacuum of FIG. 11A.
Figure 11C:
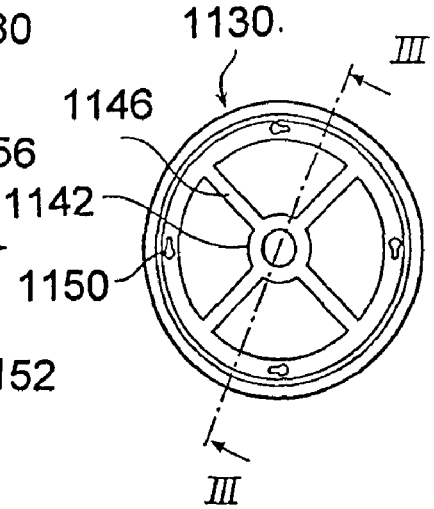
FIG. 11C is a side view of the filter unit of FIG. 11B.

Turning now to FIGS. 11B and 11C, a filter unit 1116 according to a first embodiment is illustrated. The filter unit 1116 comprises an air permeable and flexible filter body 1126 having the form of a tubular bag with an open end, or top portion 1128, integrated with a filter attachment member 1130. A dust removing assembly 1132 comprising a rod 1134 and a spring 1136 is arranged inside the filter body 1126, and an end portion 1138 of the rod 1134 is connected to a closed portion 1140 of the filter body 1126. The rod 1134 is supported by a support part 1142 integrated with the filter attachment member 1130 via at least one arm 1146. Preferably, the support part 1142 forms a hole for the rod 1134. The filter body 1126 is straightened by a biasing force applied by the spring 1136 which is arranged around the rod 1134 between a rod protrusion 1148 and the support part 1142 of the attachment member 1130.

The attachment member 1130 comprises holes 1150 that are configured to receive therethrough corresponding pegs (not shown) that extend from the housing 1102 or from the dust container 1114 in order to form a bayonet joint. Resilient sealing members 1152, 1154 are arranged on the attachment member 1130 for providing an air tight seal between the housing 1102 and/or the dust container 1114.

The attachment member 1130 may also be connected by connecting the dust container 1114 to the housing 1102 and therebetween fitting and pressing the attachment member 1130, or the attachment member 1130 may be attached to the housing 1102 or the dust container 1114 by an interference fit or snap fit associated with the respective connecting part.

Figure 11D:
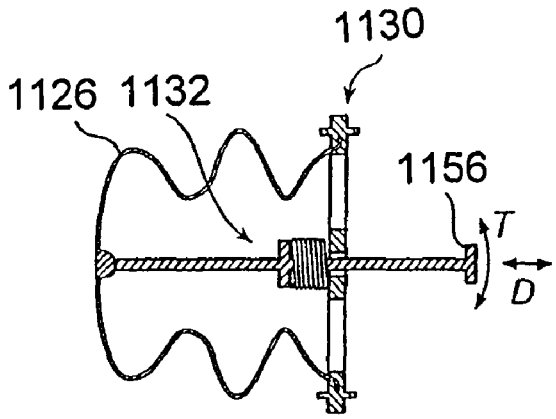
FIG. 11D is a cutaway side view of the filter unit of FIG. 11B in a contracted state.

Preferably, the filter unit 1116 is attached to the dust container 1114 and when the filter unit 1116 is to be cleaned, the dust container 1114 is removed from the housing 1102 with the filter unit 1116 still attached. Subsequently a top portion 1156 of the rod 1134 is moved in the direction of the arrow D for collapsing and expanding the filter unit 1116, or more specifically, contracting and straightening the flexible filter body 1126 as illustrated in FIG. 11D. During this operation, dust falls off the filter unit 1116 and, since it is still attached to the dust container 1114, into the dust container 1114 without spreading dust to the surroundings.

The outer surface of the filter body 1126, i.e. the surface facing the interior of the dust container 1114, is preferably sleek for preventing hair and fibers from adhering to the filter body 1126. Any known filter material with a sleek surface may be used for manufacturing the filter body 1126.

Figure 11E:
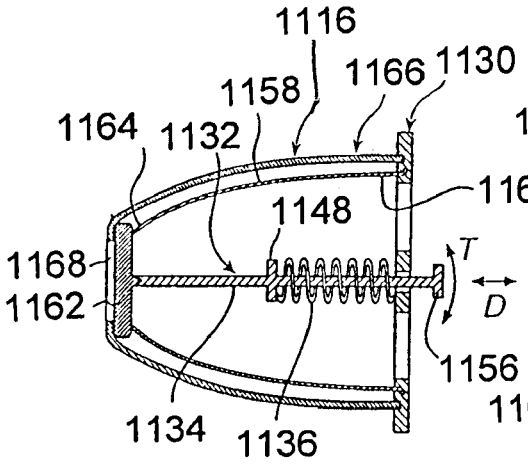
FIG. 11E is a cutaway side view of another embodiment of a filter unit of the handheld vacuum of FIG. 11A.

Turning now to FIG. 11E, a filter unit 1116 according to a second embodiment is illustrated. The filter unit 1116 comprises an air permeable and flexible fine particle-filter body 1158 having the form of a tubular bag with its open end, or top portion 1160, integrated with a filter attachment member 1130. A flexible cleaning and/or sealing part 1162 is attached to a closed portion 1164 of the particle-filter body 1158. The filter unit 1116 further comprises a coarse pre-filter body 1166 which has an opening 1168 in an end portion, encloses the particle-filter body 1158, and is connected to the attachment member 1130. It should be noted that the coarse pre-filter body 1166 filters large particles such as hair and fibers, while the particle-filter body 1158 filters smaller particles that pass through the coarse filter 1166.

Preferably, the coarse pre-filter body 1166 is detachable from the attachment member 1130, and the coarse filter body 1166 may incorporate a separate attachment member (not shown) for attachment to any of the attachment member 1130, the housing 1102, and/or the dust container 1114.

A dust removing assembly 1132 comprising a rod 1134 and a spring 1136 is arranged inside the particle-filter body 1158, and the inner portion of the rod 1134 is connected to the closed portion 1164 of the particle-filter body 1158 in a manner corresponding to the filter according to the first embodiment. The spring 1136 presses the cleaning/sealing part 1163 towards the lower part of the coarse pre-filter body 1166 and thus seals the opening 1168 during operation of the vacuum cleaner 1100.

Figure 11F:
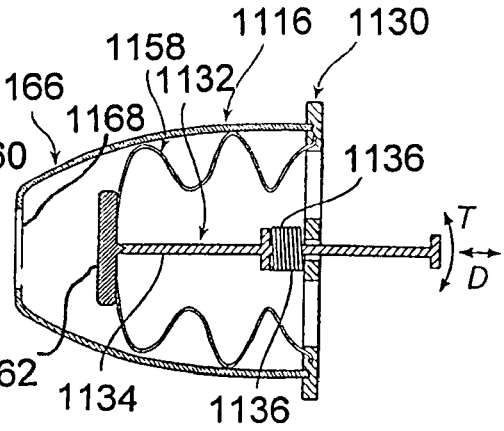
FIG. 11F is a cutaway side view of the filter unit of FIG. 11E in a contracted state.

The filter unit 1116 according to the second embodiment is attached to the dust container 1114 or the housing 1102 in a manner similar to the attachment of the first embodiment of the filter unit 1116. When the filter unit 1116 is to be cleaned, the dust container 1114 is removed from the housing 1102 with the filter unit 1116 still being attached. The top portion 1156 of the rod 1134 is then moved in the direction of the arrow D for collapsing and expanding the filter unit 1116, or more particularly, contracting and straightening the particle-filter body 1158 as illustrated in FIGS. 11E-11F. During this operation dust falls off the particle-filter 1158, out through the opening 1168 and into the dust container 1114.

If particles of dust are adhered to the interior of the pre-filter 1166, the interior may be scraped by the cleaning/sealing part 1162. To facilitate this operation there is an optional clearance between the filter attachment member 1130 and the rod 1134 to allow slight tilting of the rod along direction T.

Figure 11G:
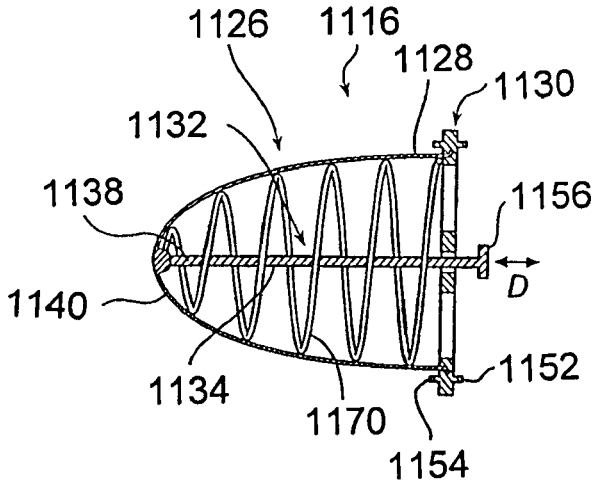
FIG. 11G is a cutaway side view of yet another embodiment of a filter unit of the handheld vacuum of FIG. 11A.

FIG. 11G illustrates a filter unit 1116 according to a third embodiment. The filter unit 1116 comprises a spring 1170 arranged inside the filter body 1126 to support the filter body 1126. The spring 1170 is at one end connected to a bottom portion 1140 of the filter body 1126 and is at its other end connected to the attachment member 1130. Preferably, the spring 1170 has a conical shape corresponding to the straightened shape of the filter body 1126, as illustrated in the figure.

Other variations of the filter systems above are contemplated. For example, the rod 1134 of the third embodiment may be omitted and replaced by a weight (not shown) arranged in a bottom portion 1140 of the filter body 1126. In this case the filter unit 1116 is to be shaken for contracting and straightening the filter body 1126. Such a weight may be used in any combination of the first and second embodiment.

The spring 1170 according to the third embodiment may also be combined with any of the filters according to the first and second embodiment. The spring 1136 of the second embodiment may, of course, be omitted to provide yet another embodiment where the spring 1170 according to the third embodiment is arranged within the particle-filter body 1158, and where the spring 1170 is connected to the bottom portion 1164 of the particle-filter body 1158 and to the attachment member 1130. The rod 1134 of the second embodiment may be omitted and replaced by a weight (not shown) arranged in a bottom portion 1164 of the particle-filter body 1158.

To remove dust that is caught between the filter unit 1116 and the dust container 1114, a rib (not shown) may be integrated with the filter unit 1116 and extend radially towards the dust container 1114. Movement of the rib allows additional dust to be removed from the dust container 1114.

The filter body or bodies and filter attachment member are integrated, for example, by bonding, gluing, melting or sewing the filter body to a surface of the attachment member, by enclosing the open end of the filter body in the attachment member, by clamping or melting the attachment member to the filter body. Preferably, the filter body and attachment member are circular as illustrated in the figures. However, the filter body and attachment member may, for example, be rectangular, triangular or have any other suitable shape.

The attachment member may have any suitable shape for attachment to the dust container and for support of the dust removing assembly and may, for example, comprise a disc with attachment holes and a support hole for the rod. Preferably, the attachment member is extruded, and preferably made of a plastic material such as polyethylene or any other similar material.

The spring may be replaced by a suitable elastic element that will provide a corresponding function. It is also possible to connect an elastic element, such as a spring or a rubber band, to the attachment member and the top portion of the rod.

Furthermore, the described spring is only one method of straightening the respective filter bodies. Other methods for straightening the filter include an interference fit or a snap-fit between the rod and the filter attachment member. When fixed to the attachment member, the rod provides a desired, straightened shape of the filter body. When the filter is to be cleaned, or the rod moved, the interference fit is manually overcome by a user.

Figure 13C:
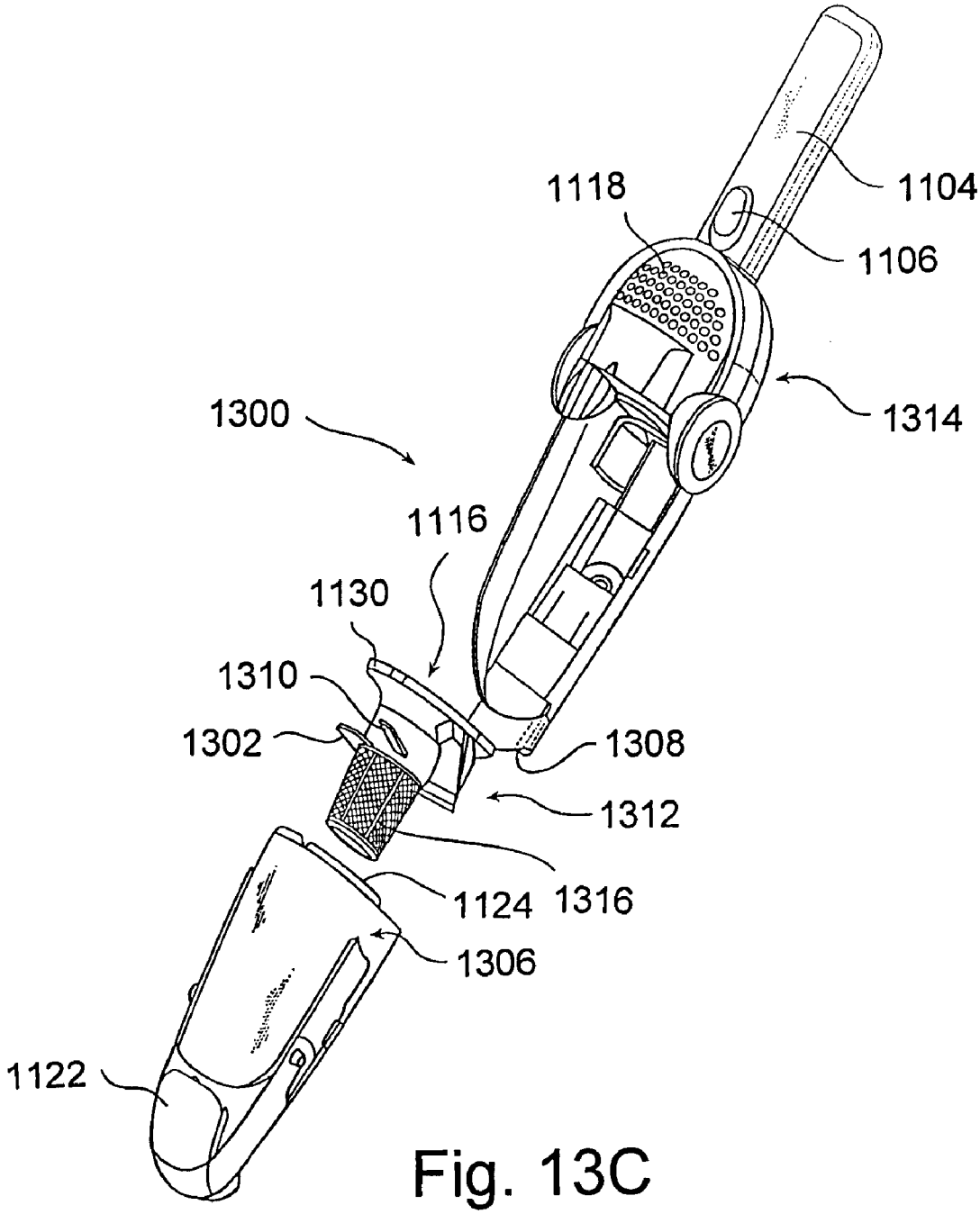
FIG. 13C is an exploded view of the handheld portion of the stick vacuum of FIG. 11A, shown with a filter unit incorporating cyclonic airflow.

Referring now to FIG. 13C, the filter units of FIGS. 11B-11G can be integrated into a cyclone insert to form a cyclonic filter unit 1312. The filter unit 1312 comprises a radial wall 1302 for preventing dust from exiting through the opening 1112 of the dust container 1306 when the vacuum cleaner 1300 is held with its opening 1308 in an upward direction. An air-flow guiding vane 1310 is arranged on the exterior of the filter unit 1312 for enhancing the cyclonic effect around the filter unit 1312 during operation. Several air-flow guiding vanes may be used, and the vanes may also be arranged on the interior of the dust container 1306 or on the housing 1314. A support frame 1316 may also be arranged to provide greater support for the filter unit 1312.

Figure 14B:
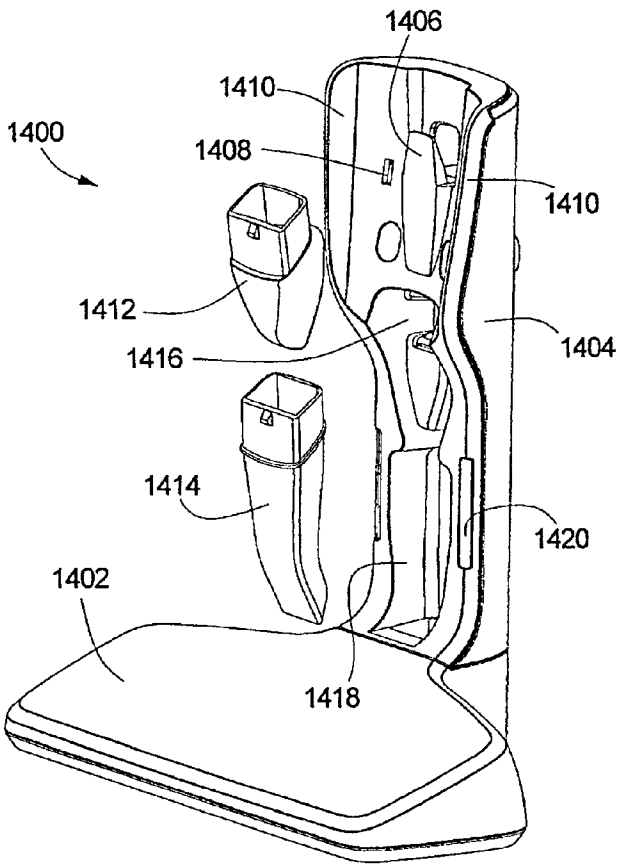
FIGS. 14A and 14B are isometric views of a charging stand for the convertible stick vacuum of FIG. 1A, shown with accessory tools stored therein, and with the accessory tools removed, respectively.
Figure 14A:
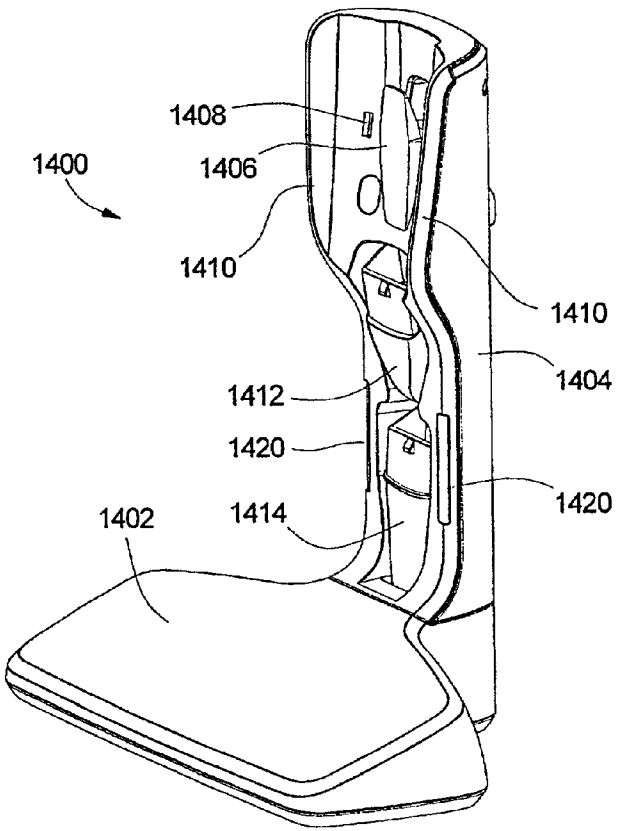

Referring now to FIGS. 14A and 14B, a preferred embodiment of a charging stand 1400 for a convertible stick vacuum 100 is illustrated and described. The charging stand 1400 provides a storage location for the vacuum 100, and, if the vacuum 100 is operated by rechargeable batteries, may also provide a charging system that connects to and charges the rechargeable batteries. The charging stand 1400 preferably comprises a base 1402 that is adapted to stand on a floor or other surface, and an upright 1404 that extends upwardly from the base 1402. A hook 1406 protrudes from the front surface of the upright 1404 to engage a corresponding slot 380 (FIG. 3) on the stick vacuum 100, and a pair of electrical contacts 1408 are provided adjacent the hook 1406 to contact corresponding main electrical contacts 348 on the stick assembly 1002. A pair of side guides 1410 protrude from the upright 1404 along each side of the hook 1406 and contacts 1408 to help guide the slot 380 onto the hook 1406 and prevent the vacuum 100 from rotating side-to-side on the hook 1406. The upright 1404 may be constructed separately and removable from the base 1402 and adapted to mount to a wall or other generally vertical surface. One or more lights 1420 may also be provided to indicate, for example, that the device is charging or connected to a wall outlet.

In a preferred embodiment, the charging stand 1400 also provides storage for one or more cleaning accessories or tools associated with the vacuum cleaner 100. For example, in the embodiment of FIGS. 14A and 14B, an upholstery brush 1412 and crevice tool 1414 are stored in corresponding openings 1416, 1418 in the front face of the upright 1404. Snaps, hooks, or other mechanisms may be used to retain the brush 1412 and crevice tool 1414 in their respective openings 1416, 1418. The brush 1412 and crevice tool 1414 can be inserted in the handheld inlet nozzle 114 for use therewith. In this embodiment, the tools 1412, 1414 can be stored such that they are out of sight when the vacuum cleaner 100 is mounted on the charging stand 1400, which may provide a more desirable aesthetic appearance and help prevent loss of the tools 1412, 1414.

Figure 15B:
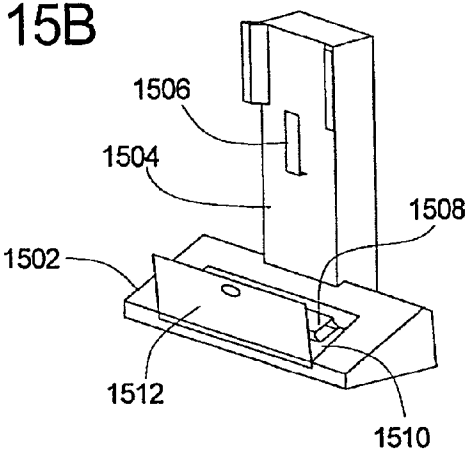
FIGS. 15A-15D are isometric views of alternative storage stands for stick vacuum cleaners.
Figure 15D:
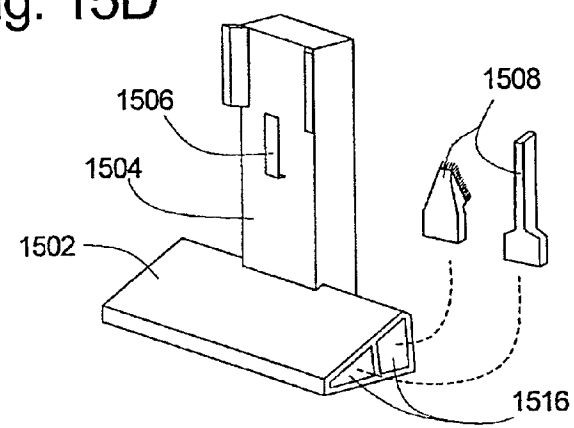
Figure 15A:
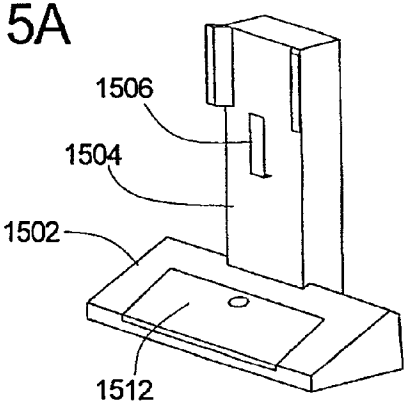
Figure 15C:
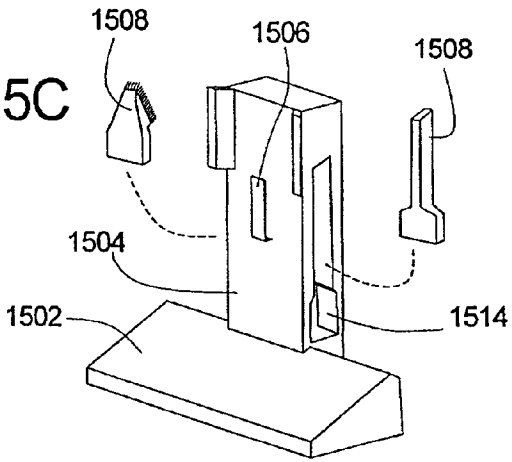

While the foregoing tool storage system is preferred, tools or other devices, such as replacement belts, filters, and the like, can be stored in the charging stand in other ways. Examples of such alternatives are shown in FIGS. 15A-D, which all provide a base 1502 having an upright 1504 and mounting hook 1506, as described with reference to FIGS. 14A-B. In the embodiment of FIGS. 15A and 15B, for example, tools 1508 and the like may be stored in an opening 1510 in the base 1502 that may be covered by a door 1512. In the embodiment of FIG. 15C, the tools 1508 are stored in openings 1514 located on the sides of the charging stand. In the embodiment of FIG. 15D, the tools are stored in compartments 1516 in the side of the base 1502. The tools also may be stored on posts that extend from the charging stand, rather than being recessed openings. Other variations will be apparent to those of ordinary skill in the art in view of the disclosure herein.

While the convertible stick vacuum 100 may be adapted to be suspended from a charging stand, such as those disclosed herein, it will also be appreciated that the stick vacuum could be constructed such that it can stand on its own.

The embodiments described herein are preferred, but are not intended to limit the scope of the invention. Many additional variations of the embodiments described herein will be apparent to those of ordinary skill in the art in view of the present disclosure and with practice of the invention. Furthermore, while various features of the invention have been described as being used together, it will be appreciated that many of these features have separate utility and inventiveness on their own, and are not required to be used together in every or any embodiment of the invention. As such, the present invention includes embodiments in which the features described herein are used individually or in various other inventive combinations. Such alternative embodiments, modifications and combinations of the various features described herein are within the scope of the present invention, which is limited only by the appended claims.

We claim:

1. A vacuum cleaner comprising:

a base having a base inlet configured to be positioned to face a surface to be cleaned;

a handle pivotally connected to the base;

an air passage connecting the base inlet to the handle;

a removable handheld unit selectively connectable to the handle, the handheld unit comprising a handheld inlet nozzle, a dirt separator, a vacuum fan adapted to selectively generate a working airflow into the handheld inlet nozzle and through the dirt separator, and a housing joining the handheld inlet nozzle, the dirt separator and the vacuum fan;

a docking latch having a first latch position in which the docking latch holds the handheld unit in an operating position on the handle, and a second latch position in which the docking latch permits removal of the handheld unit from the operating position, wherein the handheld inlet nozzle is in fluid communication with the air passage when the handheld unit is in the operating position; and a safety catch comprising a first catch member on the handle and a second catch member on the handheld unit, the first catch member and the second catch member being configured to resiliently hold the handheld unit on the handle in a partially-removed position;

wherein the first catch member comprises a pair of cantilevered protrusions extending from the handle and the second catch member comprises a pair of detents formed on the handheld unit; and wherein the pair of detents are positioned between the pair of cantilevered protrusions with the protrusions located in the detents, when the handheld unit is in the partially-removed position.

2. The vacuum cleaner of claim 1, wherein the docking latch is mounted on the handle, and in the first latch position the docking latch engages a latch receptacle on the handheld unit.

3. The vacuum cleaner of claim 1, wherein the dirt separator is physically located between the handheld inlet nozzle and the vacuum fan, and the housing comprises a hand grip extending away from a side of the handheld unit opposite the handheld inlet nozzle.

4. The vacuum cleaner of claim 3, wherein the docking latch is mounted on the handle, and in the first latch position the docking latch engages a latch receptacle located proximal to an end of the hand grip.

5. The vacuum cleaner of claim 1, wherein the dirt separator comprises at least one of a cyclone, a bag or a dirt cup.

6. The vacuum cleaner of claim 1, wherein the dirt separator comprises a dirt receptacle selectively connected to the housing and removable from the housing to empty the contents of the dirt receptacle.

7. The vacuum cleaner of claim 1, wherein the first catch member comprises at least two first catch elements, and the second catch member comprises at least two second catch elements.

8. The vacuum cleaner of claim 1, wherein at least one of the first catch member and the second catch member is resiliently biased to frictionally engage the first catch member with the second catch member to resiliently hold the handheld unit on the handle in the partially-removed position.

9. The vacuum cleaner of claim 1, wherein the handle comprises a concave recess in which at least a portion of the handheld unit fits when the handheld unit is in the operating position, and the pair of cantilevered protrusions are located on opposing sidewalls of the concave recess.

10. The vacuum cleaner of claim 1, wherein:

the handheld unit is oriented with the handheld inlet nozzle proximal to the air passage and the remainder of the handheld unit against the handle when the handheld unit is in the operating position; and the handheld unit is oriented with the handheld inlet nozzle proximal to the air passage and the remainder of the handheld unit pivoted away from the handle when the handheld unit is in the partially-removed position.

11. A vacuum cleaner comprising:

a base having a base inlet configured to be positioned to face a surface to be cleaned;

a handle pivotally connected to the base;

an air passage connecting the base inlet to the handle;

a removable handheld unit selectively connectable to the handle, the handheld unit comprising a handheld inlet nozzle, a dirt separator, a vacuum fan adapted to selectively generate a working airflow into the handheld inlet nozzle and through the dirt separator, and a housing joining the handheld inlet nozzle, the dirt separator and the vacuum fan;

a docking latch comprising a hook on one of the handle and handheld unit, and a latch on the other of the handle and the handheld unit, at least one of the hook and the latch being movable into engagement with the other to hold the handheld unit in a first position on the handle; and a safety catch comprising a first catch member on the handle and a second catch member on the handheld unit, the first catch member and the second catch member being configured to resiliently hold the handheld unit on the handle in a partially-removed position;

wherein the first catch member comprises a pair of cantilevered protrusions extending from the handle and the second catch member comprises a pair of detents formed on the handheld unit; and wherein the pair of detents are positioned between the pair of cantilevered protrusions with the protrusions located in the detents, when the handheld unit is in the partially-removed position.

12. The vacuum cleaner of claim 11, wherein the hook is on the handle and the latch is on the handheld unit.

* * * * *